US005678125A

United States Patent [19]

Kutsuwada et al.

[11] Patent Number: 5,678,125

[45] Date of Patent: Oct. 14, 1997

[54] IMAGE FORMING APPARATUS

[75] Inventors: Akio Kutsuwada, Kawasaki; Masaru Tanaka, Yokohama; Takeo Suda, Tokyo; Mitsuru Sato, Matsudo; Toshitaka Yamaguchi, Omiya; Kenzou Tatsumi, Yokohama, all of Japan

[73] Assignee: Ricoh Company, Ltd., Tokyo, Japan

[21] Appl. No.: 648,921

[22] Filed: May 16, 1996

[30] Foreign Application Priority Data

May 17, 1995 [JP] Japan ..... 7-142648
May 19, 1995 [JP] Japan ..... 7-145479

[51] Int. Cl.[6] ..... G03G 15/00

[52] U.S. Cl. ..... 399/26; 399/24; 399/29

[58] Field of Search ..... 399/24, 26, 29

[56] References Cited

U.S. PATENT DOCUMENTS

| | | | |
|---|---|---|---|
| 4,851,875 | 7/1989 | Tanimoto | 399/24 |
| 4,862,212 | 8/1989 | Tanzawa et al. . | |
| 5,008,711 | 4/1991 | Sakamoto et al. | 399/24 |
| 5,021,828 | 6/1991 | Yamaguchi et al. | 399/24 |
| 5,066,978 | 11/1991 | Watarai et al. | 399/24 |
| 5,101,233 | 3/1992 | Ito et al. | 399/24 |
| 5,160,967 | 11/1992 | Tonegawa | 399/26 |
| 5,225,873 | 7/1993 | Lux et al. | 399/26 |
| 5,278,612 | 1/1994 | Inui | 399/26 |
| 5,548,374 | 8/1996 | Iguchi et al. | 399/24 |

FOREIGN PATENT DOCUMENTS

| | | |
|---|---|---|
| 60-32074 | 2/1985 | Japan . |
| 62-127874 | 6/1987 | Japan . |
| 63-138380 | 6/1988 | Japan . |
| 2-160262 | 6/1990 | Japan . |
| 4-282661 | 10/1992 | Japan . |
| 6-186804 | 7/1994 | Japan . |

*Primary Examiner*—Matthew S. Smith

*Attorney, Agent, or Firm*—Oblon, Spivak, McClelland, Maier & Neustadt, P.C.

[57] ABSTRACT

In an image forming apparatus, a latent image electrostatically formed on a photoconductive element is developed by a two-ingredient type developer consisting of toner and carrier. The photoconductive element has a life coincident with the life of the developer. When the photoconductive element and developer reach the end of their life, they are replaced at the same time.

28 Claims, 17 Drawing Sheets

IMAGE FORMING APPARATUS

BACKGROUND OF THE INVENTION

The present invention relates to an image forming apparatus for electrostatically forming a latent image on an image carrier and developing it with a two-ingredient type developer, i.e., toner and carrier mixture stored in a developing device to thereby produce a corresponding toner image.

An image forming apparatus of the type described is implemented as, e.g., an electrophotographic copier, printer, facsimile apparatus, or a combination thereof. The apparatus has a number of image forming devices including the above image carrier and developing device. The developing device stores the two-ingredient type developer and includes a developer carrier for conveying the developer deposited thereon to a developing station. The developer carrier, as well as other elements or devices, deteriorates due to aging and finally becomes unusable. Usually, the individual element is replaced with a new element when or just before it becomes unusable. The life of each element ends when it should be replaced.

The various elements or devices constituting the apparatus must each be replaced when the respective life ends, as stated above. However, replacing the elements one by one is time- and labor-consuming. In light of this, there has been proposed an image forming apparatus whose various constituent parts are configured such that their lives end at the same time. Although this kind of apparatus allows the constituent parts to be replaced at the same time, it gives no consideration to the relation between the life of the carrier contained in the developer and the lives of the constituent parts. When the carrier of the developer deteriorates, it must be replaced with fresh carrier alone.

The life of the individual device of an image forming apparatus is discussed in, e.g., Japanese Patent Laid-Open Publication Nos. 63-138380, 2-160262, 62-127874, 60-32074, 4-282661, and 6-186804.

SUMMARY OF THE INVENTION

It is therefore an object of the present invention to provide an image forming apparatus which allows its image forming devices to be replaced easily and efficiently.

It is another object of the present invention to provide an image forming apparatus obviating the troublesome operation for replacing only the deteriorated carrier of a developer.

In accordance with the present invention, an image forming apparatus using a two-ingredient type developer consisting of toner and carrier has an image carrier for electrostatically forming a latent image thereon, and a developing device for developing the latent image with the developer to thereby produce a corresponding toner image. The developing device includes a developer carrier for conveying the developer deposited thereon. The image carrier has a life coincident with the life of the developer.

Also, in accordance with the present invention, an image forming unit using a two-ingredient type developer consisting of toner and carrier has an image carrier for electrostatically forming a latent image thereon, a developing device for developing the latent image with the developer to thereby produce a corresponding toner image. The developing device includes a developer carrier for conveying the developer deposited thereon. A unit casing is provided on which the image carrier and developer carrier are assembled integrally. The image carrier has a life coincident with the life of the developer.

Further, in accordance with the present invention, a method of forming an image with a two-ingredient type developer consisting of toner and carrier has the steps of electrostatically forming a latent image on an image carrier, developing the latent image with the developer conveyed by a developer carrier of a developing device to thereby form a corresponding toner image, and causing the life of the image carrier and the life of the developer to coincide with each other.

Moreover, in accordance with the present invention, a method of forming an image with a two-ingredient type developer consisting of toner and carrier has the steps of charging an image carrier by a charging device, electrostatically forming a latent image on the image carrier charged by the charging device, developing the latent image with the developer conveyed by a developer of a carrier of a developing device to thereby produce a corresponding toner image, removing, after the toner image has been transferred from the image carrier to a recording medium, the toner remaining on the image carrier by a cleaning device, and causing the life of the image carrier, the life of the developer, the life of the charging device and the life of the cleaning device to coincide with each other.

BRIEF DESCRIPTION OF THE DRAWINGS

The above and other objects, features and advantages of the present invention will become more apparent from the following detailed description taken with the accompanying drawings in which:

FIGS. 23, 26 and 27 each shows a specific arrangement for preventing drive gears from being displaced inward along their shafts;

DESCRIPTION OF THE PREFERRED EMBODIMENT

Figure 1:
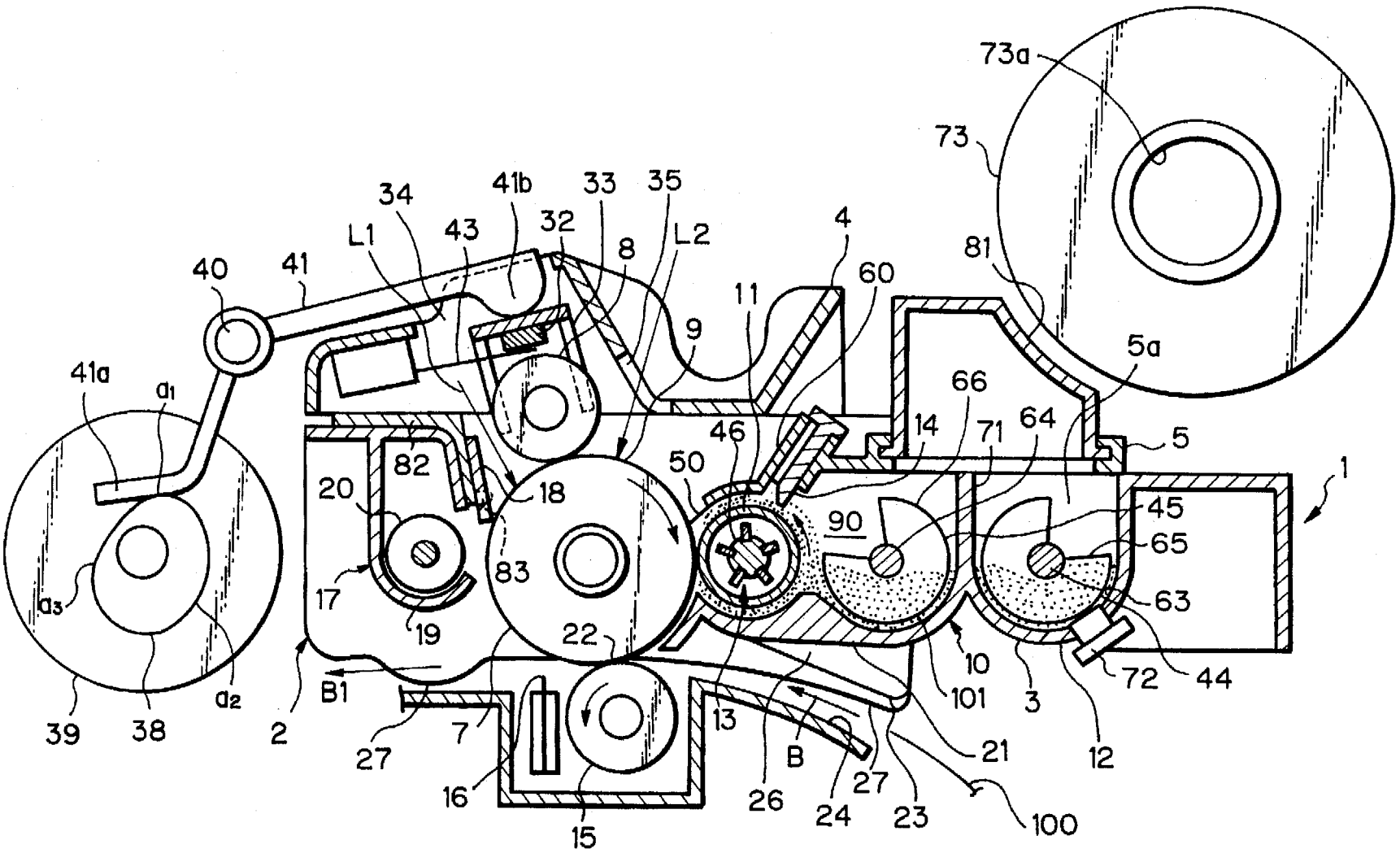
FIG. 1 is a vertical section of an image forming unit mounted to the body of an image forming apparatus.
Figure 2:
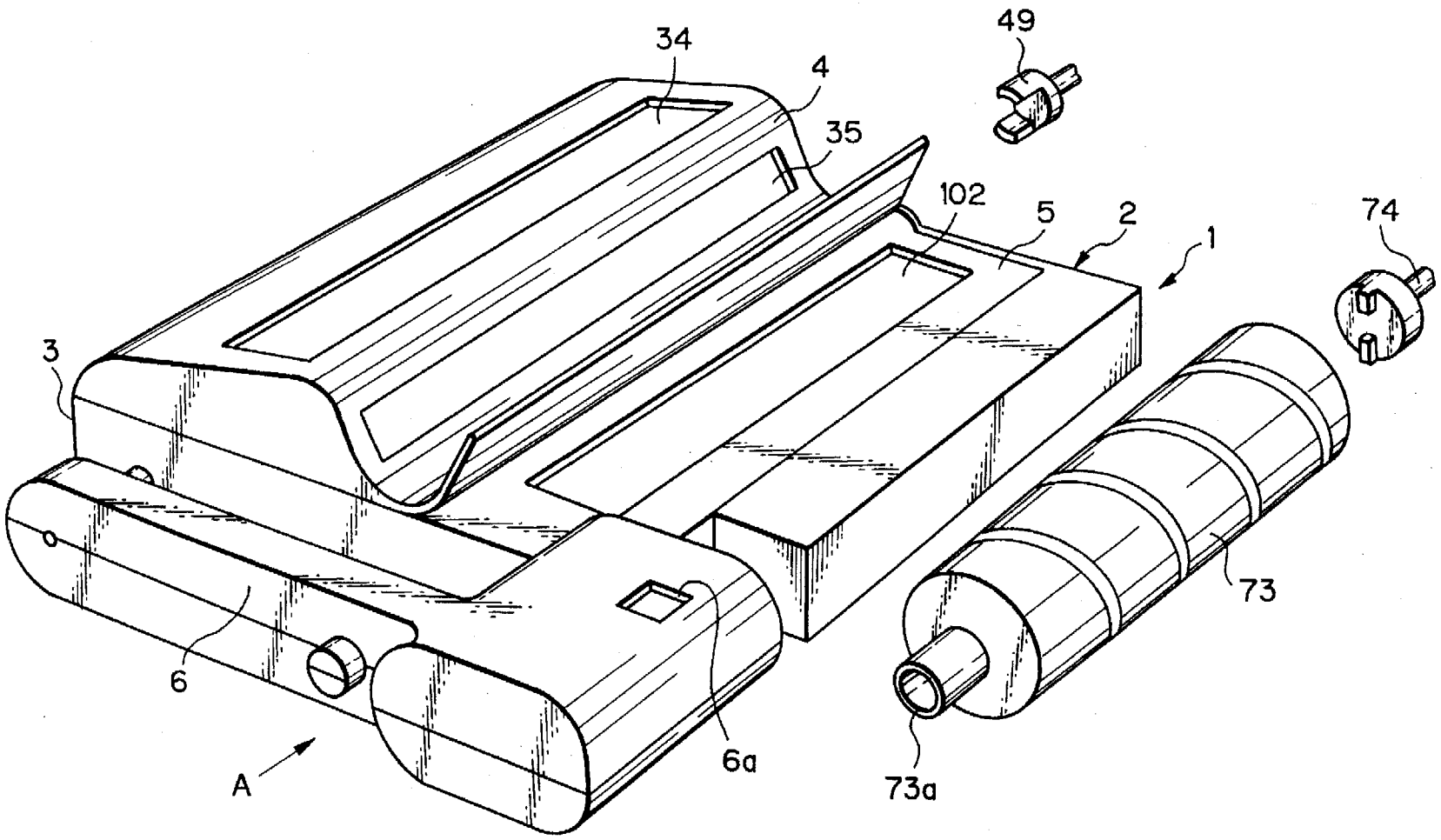
FIG. 2 is an external perspective view of the image forming unit without a developer cartridge, and a toner bottle.

Referring to FIGS. 1 and 2, an image forming unit mounted to an image forming apparatus embodying the present invention is shown. The image forming unit, generally 1, is mounted to the body, not shown, of the apparatus. The unit 1 is inserted into the apparatus body in a direction indicated by an arrow A in FIG. 2 until it reaches a preselected position shown in FIG. 1. The unit 1 can be pulled out of the apparatus body in the direction opposite to the above direction. The apparatus may be implemented as, e.g., an electrophotographic copier, printer, facsimile apparatus or their combination.

The image forming unit 1 has a unit casing 2 accommodating various image forming devices which will be described later. In the illustrative embodiment, the unit casing 2 is made up of a casing body 3, a casing cover 4 mounted on the top of the body 3, a development casing cover 5 forming the top wall of a developing device which will be described later, and a top cover 6 forming the top wall of a toner conveyance path, which will also be described later, and a part of the top wall of the developing device. The covers 4, 5 and 6 are removably attached to the casing body 3 by snap fitting. The development casing cover 5 is formed with an opening 102 (FIG. 2) which is usually closed by a developer cartridge 81 (FIG. 1).

Figure 3:
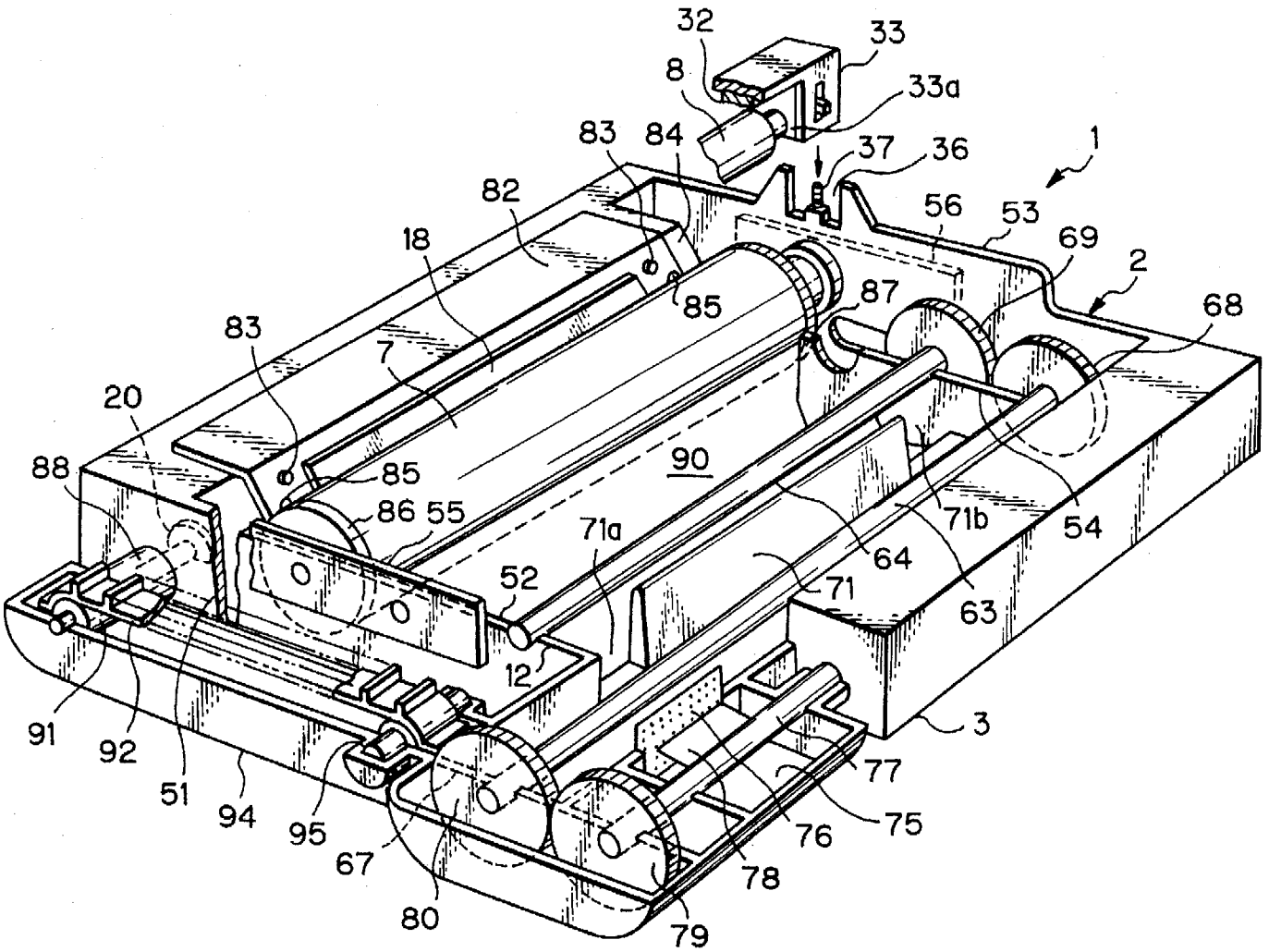
FIG. 3 is a perspective view of the image forming unit from which a casing cover, a development casing cover and a top cover are removed.
Figure 4:
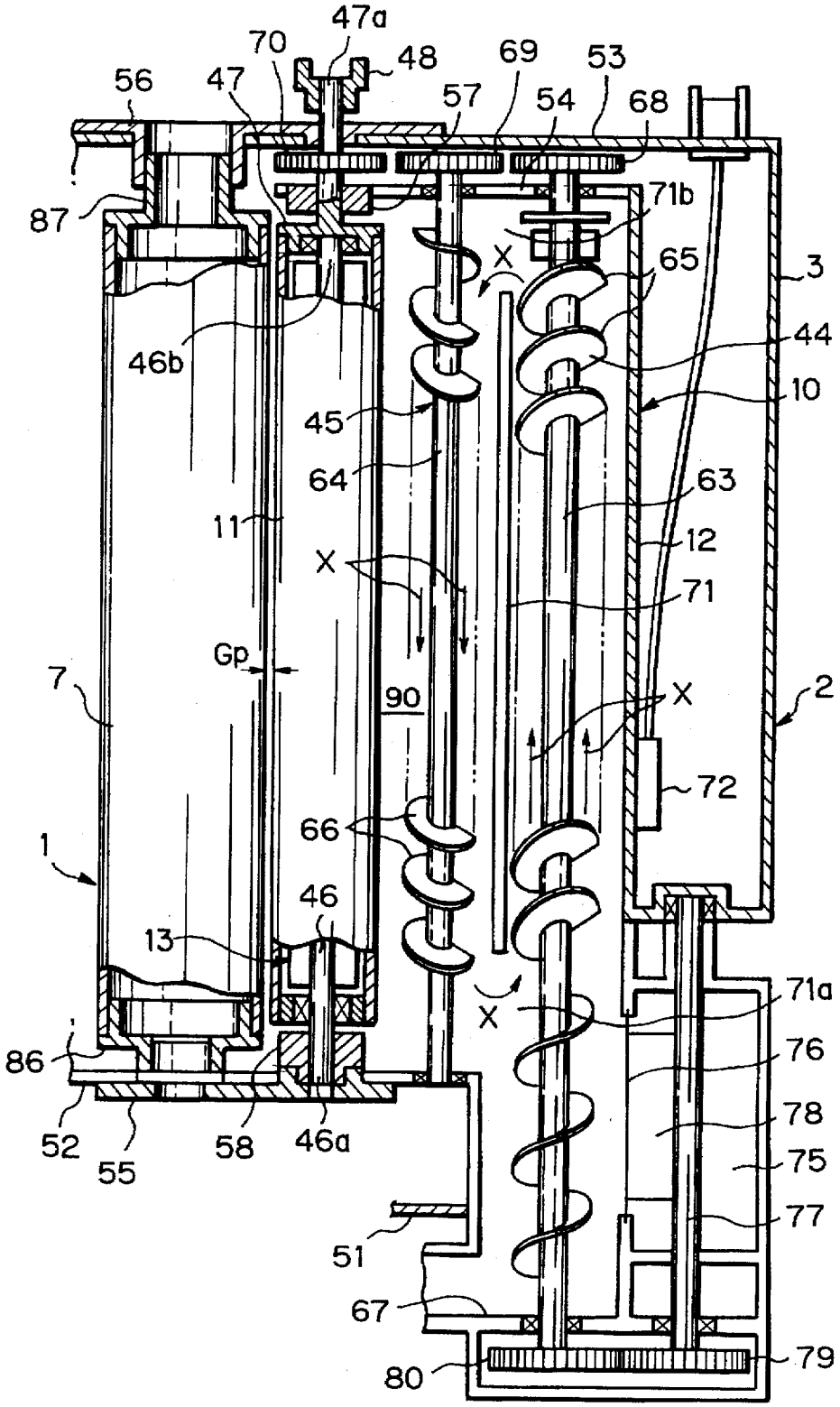
FIG. 4 is a fragmentary sectional plan view showing the image forming unit in the same condition as in FIG. 3.

The image forming unit 1 appears as shown in FIG. 3 when the casing cover 4, development casing cover 5 and top cover 6 are removed from the body 3. FIG. 4 is a fragmentary sectional plan view showing the unit 1 in the same condition as in FIG. 3. As shown, a photoconductive drum and a charge roller 8 are rotatably mounted on the unit casing 2. The drum 7 is a specific form of an image carrier for electrostatically forming a latent image thereon while the charge roller 8 is a specific form of a charging device. The charge roller 8 extends parallel to the drum 7. In FIG. 3, the charge roller 8 is shown in a position spaced from the drum 7.

In the event of image formation, the drum 7 is rotated clockwise, as viewed in FIG. 1, by a drive mechanism, not shown. A discharger, not shown, supported by the apparatus body emits discharge light L1. The light L1 is incident to the surface of the drum 7 via an opening 34 formed in the casing cover 4, so that the surface potential of the drum 7 is leveled to a reference potential between, e.g., 0 V and −150 V. On the other hand, the charge roller 8 is pressed against the drum 7 and caused to rotate by the drum 7. In this condition, the roller 8 uniformly charges the surface of the drum 7 to, e.g., about −1100 V. For this purpose, a power source, not shown, applies a preselected voltage to the roller 8.

At an exposing station 9, a laser beam L2 subjected to optical modulation scans the surface of the drum 7 charged to a preselected polarity as stated above. Specifically, the laser beam L2 issues from optics, not shown, mounted on the apparatus body and enters the unit casing 2 via an opening 35 also formed in the casing cover 4. As a result, a latent image is electrostatically formed on the drum 7. For example, the surface potential of the drum 7 is changed to 0 V to −290 V in the portion illuminated by the beam L2 (image portion), while substantially holding the previously mentioned −1100 V in the other portion (background). If desired, a document, not shown, may be illuminated in order to form a latent image based on an imagewise reflection from the document.

As shown in FIGS. 1 and 4, a developing device 10 includes a developing sleeve 11 not shown in FIG. 3. The sleeve 11 is mounted on the unit casing 2 and rotated counterclockwise, as viewed in FIG. 1, during the course of image formation. The developing device 10 has a development casing 12 constituted by a part of the casing body 3 and the development casing cover 5 covering the top of the body 3. A developing chamber 90 is formed in the casing 12. A toner and carrier mixture, i.e., two-ingredient type developer 101 (FIG. 1) is stored in the chamber 90. A plurality of magnets, generally 13, are unmovably disposed in the sleeve 11.

When the sleeve 11 is rotated, the developer 101 in the casing 12 is deposited on the sleeve 11 by the force of the magnets 13 and conveyed thereby. A doctor blade or regulating member 14 regulates the amount of the developer being conveyed by the sleeve 11. The developer regulated by the blade 14 is brought to a developing station between the sleeve 11 and the drum 7. A bias of, e.g., about −800 V is applied to the sleeve 11 for development. As a result, toner existing in the developer reached the developing station is electrostatically transferred from the sleeve 11 to the image portion of the drum 7. In this manner, the latent image formed on the drum 7 turns out a corresponding toner image. The sleeve 11 is a specific form of a developer carrier for conveying the two-ingredient type developer 101 deposited thereon.

As shown in FIG. 1, a transfer roller 15 is rotatably mounted on the apparatus body and positioned to face the drum 7. The transfer roller 15 is a specific form of an image transferring device. A paper or similar recording medium 100 is fed from a paper feeding device, not shown, mounted on the apparatus body. The paper 100 is transported to an image transfer station 22 between the drum 7 and the transfer roller 15, as indicated by an arrow B in FIG. 1. The paper 100 is passed through the station 22 with its leading edge aligned with the leading edge of the toner image carried on the drum 7. At this instant, the transfer roller 15 is rotated counterclockwise, as viewed in FIG. 1, contacting the drum 7 via the paper 100. A bias for image transfer is applied to the roller 15. In this condition, the toner image is transferred from the drum 7 to the paper 100.

The paper 100 separated from the drum 7 is transported to a fixing device, not shown, as indicated by an arrow B1 in FIG. 1. The fixing device fixes the toner image on the paper 100 by heat and pressure. A discharge needle 16 is positioned downstream of the image transfer station 22 in the direction of paper transport and supported by the apparatus body. The discharge needle 16 is implemented by a thin sheet metal extending parallel to the drum 7. The portion of the needle 16 facing the drum 7 is provided with a saw-toothed configuration having sharp tips. A voltage is applied to the needle 16 from a power source, not shown, so that the needle 16 discharges the paper 100 and thereby promotes the separation of the paper 100 from the drum 7.

If desired, an arrangement may be made such that the toner image is transferred from the drum 7 to an intermediate transfer member (primary transfer) and then transferred to the paper 100 (secondary transfer).

As shown in FIG. 1, a cleaning device 17 has a cleaning blade 18 for scraping off the toner left on the drum 7 after the image transfer. The blade 18 prepares the drum 7 for the next image formation. The device 17 has a cleaning case 19 formed by a part of the casing body 3 and accommodating a rotatable conveyor member 20. The toner removed from the drum 7 by the blade 18 is conveyed to the outside of the device 17 by the conveyor member 20. This part of the toner is again used by the developing device 10. The conveyor member 20 may be implemented as a screw, coil or the like. The blade 18 is a specific form of a cleaning member and is affixed to the casing body 3 in a configuration which will be described later.

As shown in FIG. 1, an upper guide 23 and a lower guide 24 are so positioned as to guide the paper 100 accurately toward the drum 7, i.e., the image transfer station 22. The lower guide 24 is implemented by a guide member affixed to the apparatus body and additionally serves to guide the paper 100 moved away from the station 22 in the direction B1.

The upper guide 23 may also be implemented by a guide member affixed to the apparatus body. This, however, would increases the number of parts and therefore the cost of the apparatus. In the illustrative embodiment, the lower part of the casing body 3 forms the upper guide 23 for regulating the paper 100 as to the direction. Specifically, the unit casing 2 is positioned relative to the apparatus body such that the lower part of the casing 2 forms the upper guide 23. The upper guide 23 is spaced above the lower guide 24 and positioned upstream of the image transfer station 22 in the direction of paper transport. The upper guide 23 implemented by the unit casing 2 eliminates the need for an independent guide member and thereby reduces the number of parts and cost of the apparatus.

Figure 5:
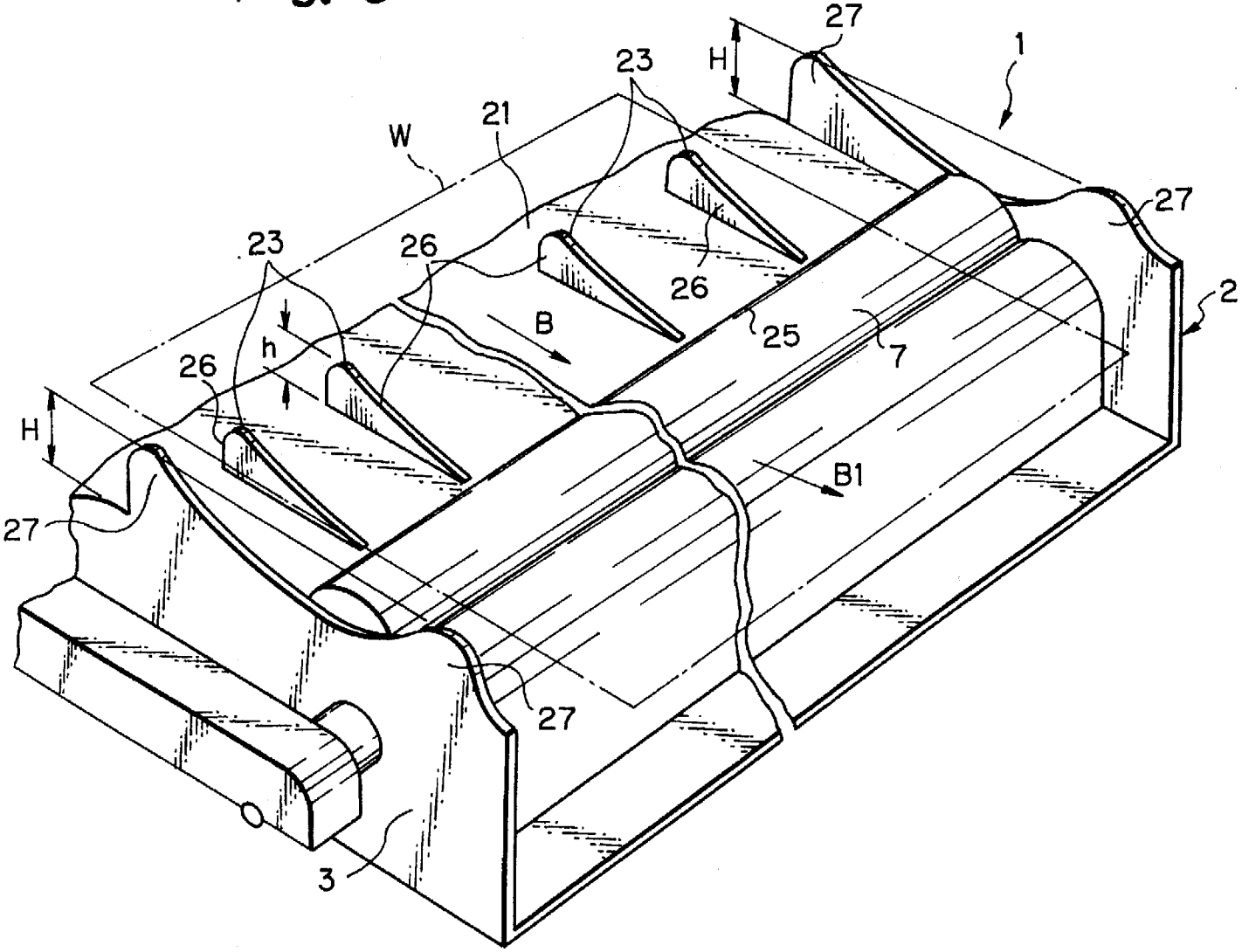
FIG. 5 is a perspective view of a casing body turned upside down.

FIG. 5 shows the casing body 3 of the unit casing 2 turned upside down from the position of FIG. 3. As shown, the drum 7 partly protrudes to the outside of the casing 2 through a slot 25 formed in the bottom wall 21 of the casing body 3. In FIG. 5, an arrow B, like the arrow B of FIG. 1, shows the direction in which the paper 100 is transported toward the image transfer station 22 (FIG. 1). Labeled W is a range over which the paper 100 passes and covering even the maximum paper size.

As shown in FIGS. 1 and 5, the upper guide 23 is implemented as a plurality of guide ribs 26 extending from the bottom wall 21 of the casing body 3. The ribs 26 are each elongate in the direction B in which the paper 100 is transported. The fibs 26 are spaced from each other in the direction perpendicular to the direction B and confined to the range W. Even the paper 100 of maximum size available with the apparatus is surely guided by the free edges of the ribs 26.

The guide ribs 26 guiding the paper 100 toward the image transfer station 22 may be replaced with, e.g., the underside of the bottom wall 21. However, a flat guide surface is likely to cause the paper 100 to electrostatically adhere thereto and to thereby deteriorate the transportability. As a result, the toner image carried on the paper 100 is apt to extend or contract. Moreover, when the toner is deposited on such a flat guide surface having a broad area, it is likely that the toner is again transferred to the leading edge of the paper in a great amount, smearing it to a critical degree.

By contrast, the guide ribs 26 guiding the paper 100 with their free edges contact the paper 100 only over an extremely small area. This prevents the paper 100 from electrostatically adhering to the guide 23 and thereby obviates defective images. In addition, even if the toner is deposited on the free edges of the ribs 26, it is prevented from being transferred to the paper 100 in a great amount because the contact area of the ribs 26 with the paper 100 is small.

As shown in FIGS. 1 and 5, a projection 27 extends from the lower portion of the unit casing 2 further than the guide 23 (downward in FIG. 1) at the outside of the area W. In the illustrative embodiment, the projection 27 extends from the lower portion of the casing body 3. In the specific configuration shown in FIGS. 1 and 5, four projections 27 in total are formed on the casing body 3, two at one side of the range W and two at the other side of the range W. The projections 27 extend from the bottom wall 21 of the unit casing 2 to a height H greater than the height h of the guide ribs 26.

When the image forming unit 1 is pulled out of the apparatus body, it is usually placed on a flat surface, e.g., a floor or a desk with the bottom of the unit casing 2 facing downward. At this instant, the projections 27 extending out further than the guide 23 rest on the flat surface and prevent the guide 23, i.e., ribs 26 from contacting the flat surface. In this condition, impurities are prevented from being transferred from the flat surface to the guide 23; otherwise, they might scratch or otherwise damage the guide 23. Therefore, when the unit 1 is again inserted into the apparatus body, the paper 100 is free from impurities while the guide 23 surely serves the expected function. Although some impurities may be transferred from the flat surface to the projections 27 or may scratch them, the projections 27 do not degrade the paper transport because they are located outside of the range W when the unit 1 is again mounted to the apparatus body.

The projections 27 may be located at positions other than the positions shown in FIG. 5 so long as they are positioned on the lower portion of the unit casing 1 outside of the range W. For example, FIG. 6 shows an alternative arrangement having two projections 27 at both sides of the paper 100 and two projections 27 upstream of the range W in the direction of paper transport; the projections 27 again extend out further than the guide ribs 26.

Figure 6:
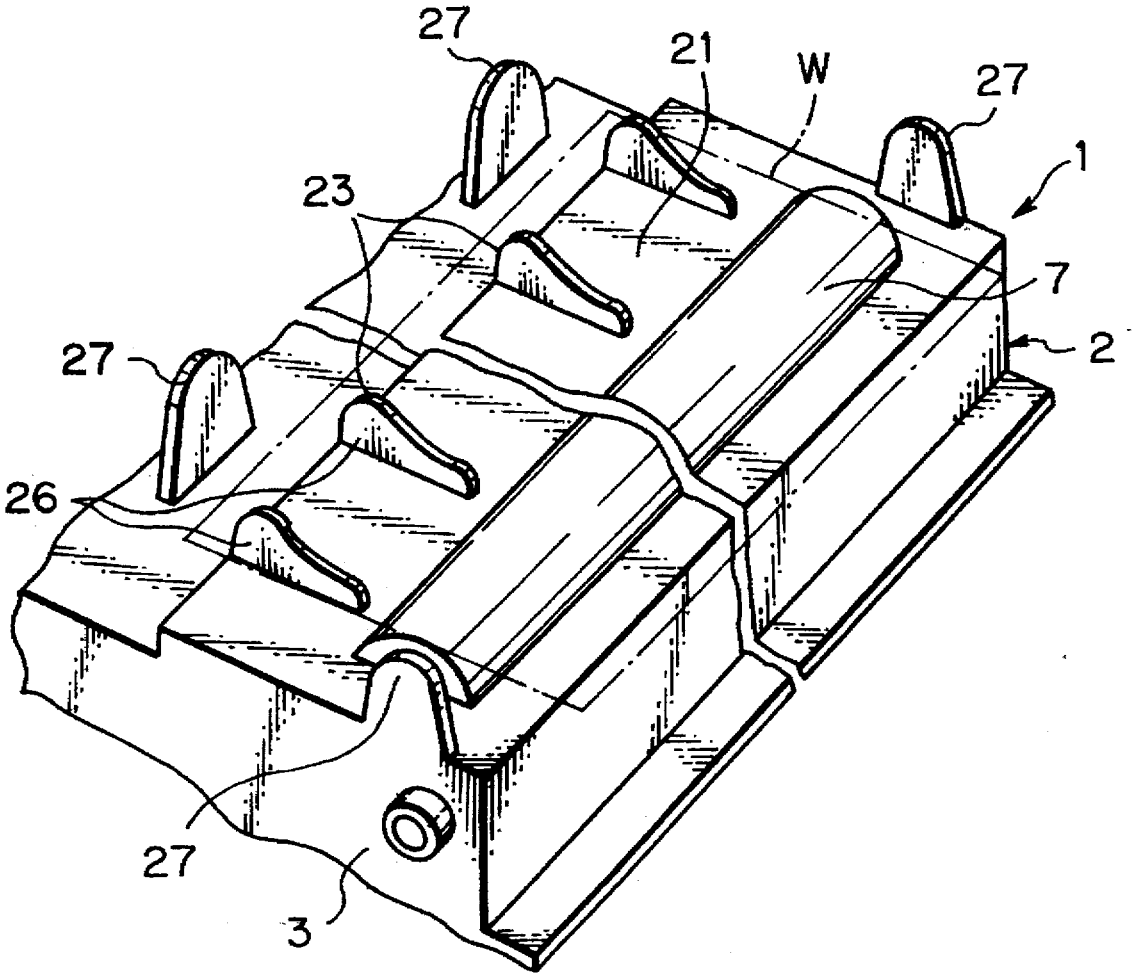
FIG. 6 is a view similar to FIG. 5, showing an alternative configuration of the casing body.

In FIGS. 1, 5 and 6, the height H of the projections 27 above the bottom wall 21 is so selected as to prevent not only the ribs 26 but also the drum 7 from contacting the flat surface on which the unit 1 removed from the apparatus body will be placed.

To better understand the embodiment, the various devices constituting the image forming apparatus and their constituents will be described in detail.

Figure 7:
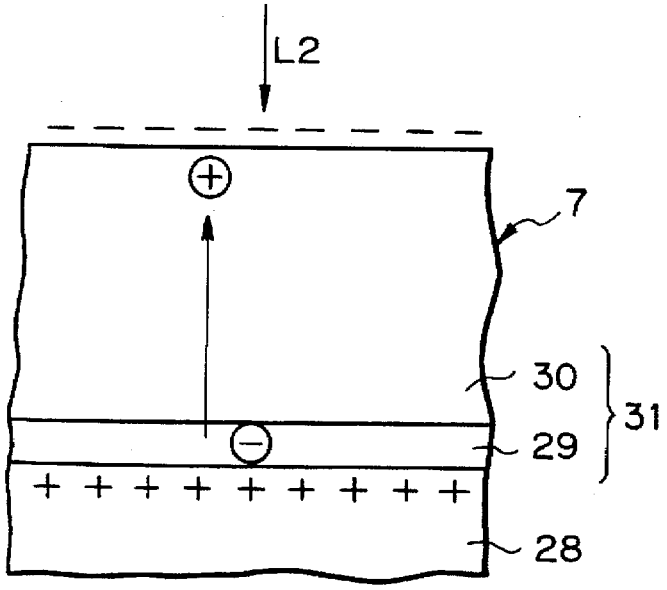
FIG. 7 is an enlarged section of a photoconductive element.

The drum 7 is implemented by a laminate OPC (Organic Photo Conductor) and has a configuration shown in FIG. 7. As shown, the drum 7 has a conductive substrate 28. A 0.1

μm to 1 μm thick charge generating layer (CGL) 29 and a 10 μm to 30 μm thick charge transfer layer (CTL) 30 are sequentially formed on the substrate 28. The two layers 29 and 30 constitute a photoconductive layer 30 in combination. The laser beam L2 incident to the drum 7 is transmitted through the CTL 30 and then absorbed by the CGL 29. The CGL 29 generates a carrier due to the resulting energy. The carrier is injected into the CTL 30 by the force of the outside field and transferred through the CTL 30 to the surface of the drum 7, thereby neutralizing the surface charge of the drum 7. The CTL 30 shown in FIG. 7 is of the hole transport type and shown in a negatively charged state.

The charge roller or charging device 8 shown in FIGS. 1 and 3 is made up of a metallic core and a conductive rubber webbing wrapped around the core. To charge the drum 7, the roller 8 is brought into contact with the surface of the drum 7. The axially opposite ends of the roller 8 are each rotatably supported by a respective bearing 33*a* (FIG. 3). A roller case 33 extends parallel to the roller 8. The bearings 33 and roller 8 are supported by the opposite ends of the roller case 33 such that they are movable toward and away from the drum 7 over a predetermined distance. A cleaning pad or roller cleaning member 32 is adhered to the surface of the roller case 33 facing and extending along the roller 8.

First compression springs, not shown, are each loaded between one end of the roller case 33 and the associated bearing 33*a*. In this condition, the bearings 33*a* are constantly biased toward the drum 7 and allow the roller 8 to contact the drum 7. The roller case 33 has its opposite ends received in notches 36 (only one is shown in FIG. 3) formed in the casing body 2, so that it is also movable toward and away from the drum 7 over a preselected distance. The case cover (FIGS. 1 and 2) prevent the roller case 33 from slipping out of the casing body 3. Second compression springs 37 (only one is shown in FIG. 3) are loaded between the opposite ends of the roller case 33 and the casing body 3, constantly biasing the roller case 33 away from the drum 7.

The casing cover 4 plays the role of a projection cover for keeping the drum 7 and charge roller 8 from the operator's hands. In addition, the casing cover 4 plays the role of a stop for preventing the roller case 33 biased by the springs 37 from slipping out of the casing body 3. This eliminates the need for an exclusive stop for the roller case 33 and thereby simplifies the construction.

As shown in FIG. 1, a solenoid-operated clutch 39 is mounted on the apparatus body in order to control the rotation of a cam 38. The cam 38 is affixed to the rotary shaft of the clutch 39. The clutch 39 is rotatable 120 degrees at a time. An arm 41 is rotatably mounted on the apparatus body via a pivot pin 40. One end 41*a* of the arm 41 is pressed against the cam 38 by a spring, not shown, while the other end 41*b* is held in contact with the top of the roller case 33 through the opening 34 formed in the casing cover 4. The top of the roller case 33 is pressed against the end 41*b* of the arm 41 by the previously mentioned second compression springs 37.

Assume that the cam 38 is held in the position shown in FIG. 1, i.e., a portion $a_1$ of its profile is held in contact with the end 41*a* of the arm 41. Then, the roller case 33 is also held in the position shown in FIG. 1. In this condition, the charge roller 8 is pressed against the surface of the drum 7 by the first compression springs, not shown, and charges it to a preselected polarity due to the voltage applied to its core.

As stated above, the charge roller 8 remains in contact with the drum 7 throughout the period for charging the drum 7. This is likely to cause fine toner particles deposited on the drum 7 to contaminate the charge roller 8, resulting in an irregular charge distribution on the drum 7. In light of this, in the illustrative embodiment, the clutch 39 is operated to rotate the cam 38 120 degrees at an adequate time other than the time for charging the drum 7. As a result, the cam 38 contacts the end 41*a* of the arm 41 at its portion $a_2$ shown in FIG. 2. The other end 41*b* of the arm 41 presses the roller case 33 toward the drum 7. Because the charge roller 8 is held in contact with the drum 7, the cleaning pad 32 is pressed against the charge roller 8. At this instant, the charge roller 8 is rotated following the rotation of the drum 7 and has its surface cleaned by the pad 32. In this manner, the charge roller 8 is prevented from charging the drum 7 in a smeared condition, so that the drum 7 is protected from an irregular charge distribution.

When the apparatus stops operating, the clutch 39 causes the cam 38 to rotate to a position where a portion $a_3$ shown in FIG. 1 contacts the end 41*a* of the arm 41. As a result, the other end 41*b* of the arm 41 is raised above the position shown in FIG. 1. This moves the roller case 33 away from the drum 7 due to the action of the second compression springs 37 and thereby moves the charge roller 8 away from the drum 7. Should the charge roller 8 be held in contact with the drum 7 for a long time in the inoperative condition of the apparatus, the drum 7 might be contaminated and bring about defective images. The embodiment obviates such an occurrence by spacing the charge roller 8 from the drum 7.

While the charge roller 8 may be replaced with a corona discharger, the roller 8 reduces ozone to 1/100 to 1/1,000, compared to the corona discharger. This makes it needless to provide the apparatus body with a special ozone processing member.

Figure 8:
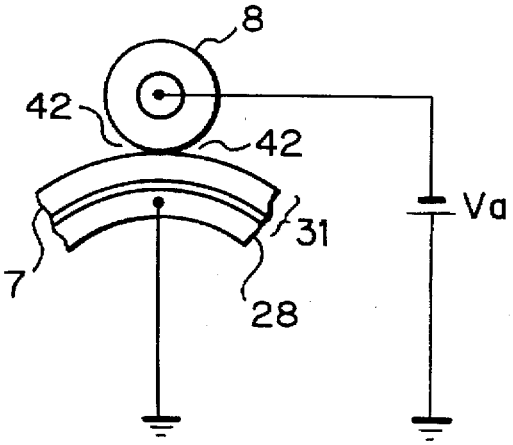
FIG. 8 shows the photoconductive element and a charge roller.
Figure 9:
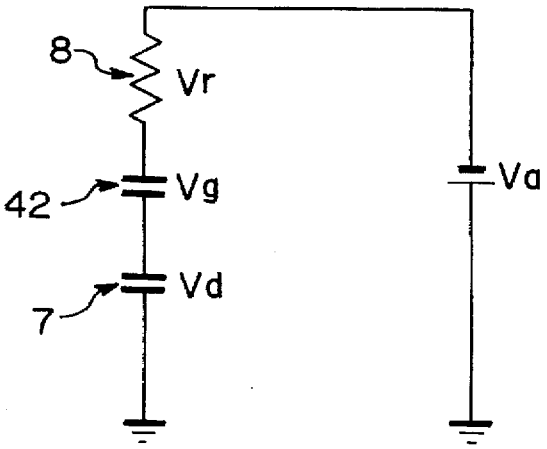
FIG. 9 shows an equivalent circuit including the charge roller and photoconductive element and a power source.

How the charge roller 8 charges the drum 7 will be described with reference to FIGS. 8 and 9. FIG. 8 schematically shows the drum 7 and charge roller 8 in a charge model while FIG. 9 is an equivalent circuit representative of the charge model. Assume that the voltage applied to the core of the charge roller 8 is Va, that the voltage acting on the charge roller 8 is Vr, that the discharge start voltage as measured at a gap 42 between the roller 8 and drum 7 is Vg, and that the surface potential of the drum 7 is Vd. Then, the following equation holds:

$$Va=Vr+Vg+Vd \tag{1}$$

Assuming that the roller 8 has a resistance R, and that a current I flows through the roller 8, then the voltage Vr acting on the roller 8 is expressed as:

$$Vr=I\cdot R \tag{2}$$

Hence, assuming that the photoconductive layer 31 of the drum 7 has a thickness d and a specific inductive capacity Kd, then the discharge start voltage Vg is produced by:

$$Vg=312+6.2\times d/Kd+\sqrt{(7737.6\times d/Kd)} \tag{3}$$

Assuming that the charge fed to the drum 7 is Q, and that the capacitance of the photoconductive layer 31 is C, then the surface potential Vd of the drum 7 is expressed as:

$$Vd=Q/C \tag{4}$$

Further, assuming that the drum 7 moves at a peripheral speed Vp, and that the charge roller 8 has a length L and a dielectric constant Ko, then there hold:

$$Q=I/L\cdot Vp \quad C=(Ko\cdot Kd)/d \quad Vd=(I\cdot d)/(Ko\cdot Kd\cdot L\cdot Vp) \tag{5}$$

Therefore, the equation (1) is written as:

$$Va = I \cdot R + 312 + 6.2 \times d/Kd + \sqrt{(7737.6 \times d/Kd)} + (I \cdot d)/(Ko \cdot Kd \cdot L \cdot Vp) \quad (6)$$

The above equations are charge model equations.

The charging using the charge roller 8 may be controlled by either a constant voltage control system or a constant current control system, as follows.

The constant voltage control maintains Va included in the equations (1) and (6) constant. In the equation (1), the term Vd is used as the charge potential of the drum 7. Therefore, changes in Vr and Vg effect Vd. Regarding the term Vr, the resistance of the charge roller 8 is a variable factor; as the resistance of the roller 8 increases due to a change in environment, Vr increases while Vd decreases. To reduce the influence of such an occurrence, it is necessary to provide temperature sensing means and correct Va on the basis of sensed temperature. Further, considering the fact that the resistance of the roller 8 noticeably increases in a low-temperature low-humidity environment, it is preferable to use, e.g., a heater in order to prevent the temperature from falling below a certain level.

The term Vg is effected by the thickness d of the photoconductive layer 31. However, assuming that the thickness d is initially 28 μm and reduced by 4 μm due to aging, and that Kd is 3.2, then Vg (28)=626 and Vg (24)=599 are produced; that is, the variation is only 27 V. This degree of variation is not considered as noticeably effecting the charge potential (usually 800 V to 1,000 V). Because the current flowing on the variation of the resistance of the roller 8 is small, the influence on Vd can be reduced if the resistance of the roller 8 is relatively low (e.g. $10^7\Omega$ or below).

The constant current control maintains I included in the equation (6) constant. This control is not effected by the term Vr or the term Vg. However, the variation of the thickness d in the term Vd directly influences Vd. Assuming that the thickness d is initially 28 μm and varies by 4 μm due to aging, as mentioned earlier, then Vd becomes Vd×24/28. As a result, assuming that Vd is initially 850 V, then it becomes 728 V due to aging, i.e., drops by more than 100 V. This is likely to deteriorate the charging ability of the roller 8. Although this problem may be solved if the variation in the thickness of the layer 31 is sensed and corrected, a mechanism for sensing it is too expensive to be actually mounted on the apparatus. The only measure available at the present stage of development is to use a photoconductor which is free from wear.

For the reasons described above, the embodiment uses the constant voltage control scheme although it must correct the voltage in association with the varying resistance of the charge roller 8. As shown in FIG. 1, a thermistor 43 is mounted on the casing cover 4 in order to sense the temperature of the roller 8. The thermistor 43 senses the surface temperature of the roller 8 and sends its output to a circuit which corrects the voltage on the basis of a change in resistance ascribable to a change in temperature. The thermistor 43 is so positioned as to contact the roller 8 when the roller 8 is released from the drum 7.

The thermistor 43 mounted on the casing cover 4 eliminates the need for an exclusive mounting member and thereby simplifies the apparatus, particularly its image forming unit 1. In addition, because the thermistor 43 contacts the roller 8 when the roller 8 is spaced from the drum 7, i.e., when no voltages are applied to the roller 8, it is protected from damage ascribable to the voltage applied to the roller 8.

As for the developing device 10, the development casing 12 stores the two-ingredient type developer or toner and carrier mixture 101 therein, as stated with reference to FIGS. 1, 3 and 4. The carrier is implemented as, e.g., fine iron balls. A first and a second agitator member 44 and 45, which will be described, agitate the developer 101 while circulating it through the chamber 90 toward the sleeve 11. The developer 101 deposited on the sleeve 11 is regulated in thickness by the doctor blade 14 adjoining the sleeve 11. The portion of the sleeve 11 facing the drum 7 is exposed to the outside through the casing 12.

The sleeve 11 is a nonmagnetic hollow cylinder formed of, e.g., aluminum and having an outside diameter of 16 mm to 20 mm by way of example. The outer periphery of the sleeve 11 is smooth or is notched or otherwise undulated in order to enhance the conveyance of the developer.

As shown in FIG. 4, a shaft 46 extends throughout the sleeve 11 and supports the previously mentioned magnets 13 thereon. The front end **46*a* of the shaft 46, as viewed in FIG. 4, is affixed to the casing body 3 of the unit casing 2 in a manner which will be described. The rear end 46*b* is received in a sleeve end member 47 via a bearing. The sleeve end member 47 is affixed to the rear end of the sleeve 11. The shaft 46 and sleeve 11 are therefore rotatable relative to each other. The sleeve end member 47 has a shaft portion 47*a* rotatably supported by the casing body 3, as will be described later. The front end of the sleeve 11 is rotatably supported by the shaft 46 via a bearing. It is to be noted that the terms "front" and "rear" are used with respect to the direction in which the image forming unit 1** is mounted to and dismounted from the apparatus body.

The shaft 46 is unmovably supported by the unit casing 2 together with the magnets 13 while the sleeve 11 is rotatably supported by the shaft 46, as stated above. A coupling 48 is mounted on the sleeve end member 47 and mated with a coupling 49 (FIG. 2) mounted on the apparatus body. The sleeve 11 is rotated counterclockwise, as viewed in FIG. 1, via the couplings 49 and 48 and sleeve end member 47. The bias for the sleeve 11 is applied from the apparatus body via the couplings 49 and 48.

Figure 10:
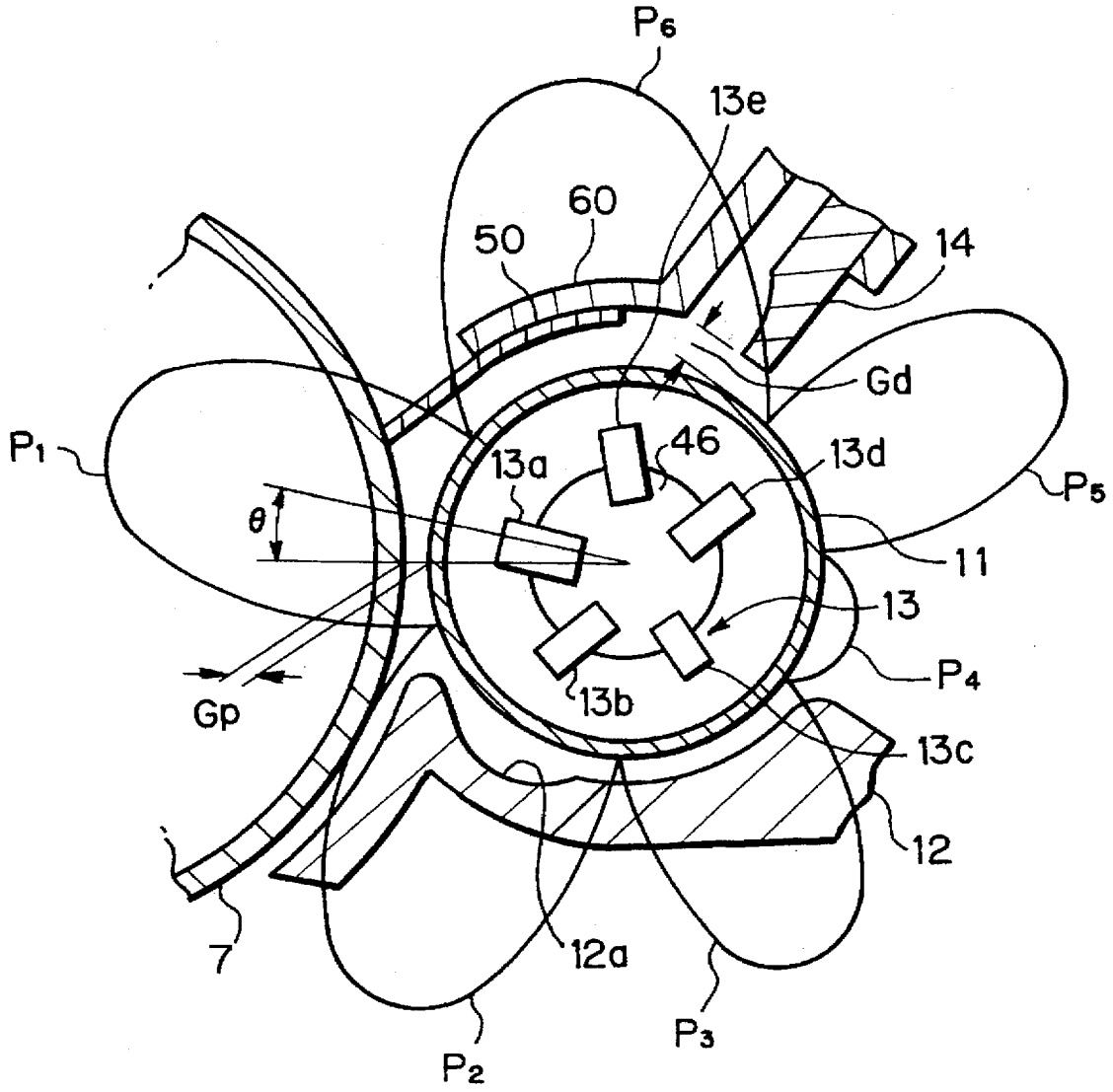
FIG. 10 is a section showing a relation between the photoconductive element and a developing device.

FIG. 10 shows a relation between the sleeve 11, the magnets 13 unmovably disposed in the sleeve 11, and the drum 7. As shown, the magnets 13, i.e., a first magnet **13*a* to a fifth magnet 13*e* are arranged on the shaft 46 in the circumferential direction of the sleeve 11, and each extends in the axial direction of the sleeve 11. Magnetism distributions $P_1$–$P_6$ generated by the magnets 13*a*–13*e*, respectively, appear in the circumferential direction of the sleeve 11**, as illustrated.

The first magnet **13*a* substantially faces the drum 7, and its magnetism distribution $P_1$ has a peak spaced at an angle θ of 3 degrees to 10 degrees above a line interconnecting the center of the drum 7 and that of the sleeve 11. The peak flux density ranges from 80 mT (millitesla) to 100 mT. If the peak flux density is short, then the carrier of the developer cannot be retained on the sleeve 11 and flies about. If the peak flux density is excessive, then the trace of the toner deposited on the drum 7 is apt to remain in the circumferential direction of the drum 7, and in addition the sleeve 11 is apt to collect the toner from the low potential portions of the drum 7**. Should the angle θ be excessive, the developing ability would be deteriorated.

The magnetism distribution $P_2$ of the second magnet **13*b* has a peak flux density of 50 mT to 80 mT in the vicinity of the opening of the casing 12. This magnetism serves to convey the developer into the casing 12 and to convey air around the bottom of the casing 12 into the casing 12. This successfully prevents the toner from flying out of the casing 12. To enhance the efficient conveyance of air, it is preferable that the portion 12*a* of the casing 12 corresponding to the peak flux density portion be slightly concave away from the sleeve 11**. This allows the developer to form a head smoothly.

The magnetism distribution $P_3$ of the third magnet 13*c* serves to convey the developer into the casing 12 and cooperates with the fourth magnet 13*d* to form the magnetism distribution $P_4$ having a flux density of 10 mT or less. In this condition, the developer is separated from the sleeve 11 after the development.

The magnetism distribution $P_5$ of the fourth magnet 13*d* serves to retain the developer fed by the second agitator member 45 (FIG. 4) on the sleeve 11. The flux density is small in the vicinity of the doctor blade 14, so that the developer can pass by the blade 14 while tightly contacting the sleeve 11. As a result, the thickness of the developer is stably regulated.

The magnetism distribution $P_6$ of the fifth magnet 13*e* serves to convey the developer retained on the sleeve 11 by the magnet 13*d* to the range of the magnet 13*a*. The peak flux density of the distribution $P_6$ is selected such that the developer contacts an inlet seal 50, which will be described, in order to stabilize the developer and to control the stream of air around the sleeve 11.

The sleeve 11 and drum 7 are spaced by a gap Gp determined by a relation between it and a gap Gd between the sleeve 11 and the blade 14. The gap satisfies the following equations:

$$Gp=Gd\times(0.8 \text{ to } 1.0) \text{ mm}$$

$$Gp-Gd=(0 \text{ to } 0.15) \text{ mm}$$

Assuming that the peripheral speed of the sleeve 11 is vs (mm/sec), and that the peripheral speed of the drum 7 is vp (mm/sec), then the following equation holds:

$$vs=(1 \text{ to } 2.5)\times vp$$

Figure 11:
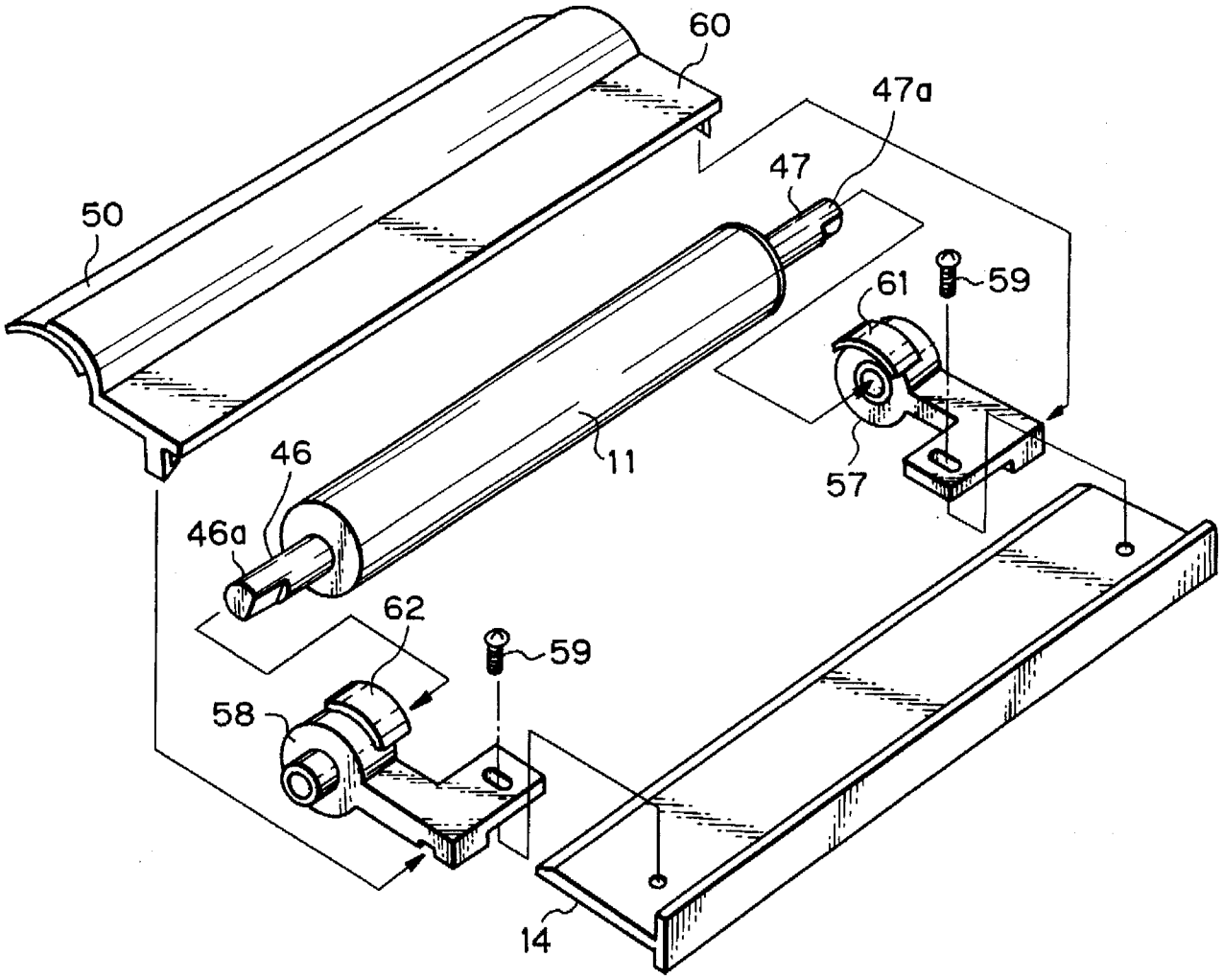
FIG. 11 is an exploded perspective view showing a doctor blade, a developing sleeve, support members, and an inlet seal cover.

As shown in FIGS. 4 and 11, the shaft portion 47*a* of the sleeve end member 47 is rotatably received in a rear support member 57. The front end 46*a* of the shaft 46 is received in a front support member 58, but unrotatable relative to the member 58. As shown in FIG. 11, the support members 57 and 58 are each formed with a slot and fastened to the doctor blade 14 by a screw 59 driven into the blade 14 via the slot. By loosening the screws 59, it is possible to adjust the position of the blade 14 relative to the sleeve 11 substantially in the direction of its normal. After the adjustment, the screws 59 are tightened to affix the blade 4 relative to the sleeve 11. The shift of the blade 14 relative to the sleeve 11 and the resulting gap between the blade 14 and the sleeve 11 have one-to-one correspondence. In addition, the above adjustment can be easily done after the blade 14 and sleeve 11 have been removed from the developing device.

As shown in FIGS. 3 and 4, the casing body 3 of the unit casing 2 has a front outer plate 51 and a front inner plate 52 at its front, and has a rear outer plate 53 and a rear inner plate 54 at its rear. The development casing cover 5 (FIGS. 1 and 2) have a front and a rear plate respectively resting on the upper edges of the inner plates 52 and 54 at their lower edges. The opposite plates of the cover 5 and inner walls 52 and 54 form the front and rear side walls of the casing 12 in combination. In this manner, the casing 12 is constituted by a part of the unit casing 2. Only the rear plate of the cover 5 is shown in FIG. 1 and labeled 5*a*.

Flanges 86 and 87 are respectively affixed to the axially opposite ends of the drum 7. The flanges 86 and 87 are respectively rotatably supported by the front inner plate 52 and rear outer plate 53 via a front and a rear positioning plate 55 and 56. A front support member 58 is coupled over the front end 46*a* of the shaft 46 and is unrotatably supported by the front inner plate 52 via the positioning plate 55. Also, the shaft portion of the sleeve end member supported rotatbly supported by the rear outer plate 53 via the positioning plate 56. A rear support member 57 is removably received in a notch formed in the rear inner plate 54.

As stated above, the front ends and rear ends of the drum 7 and sleeve 11 are supported by the unit casing 2 via the common positioning plates 55 and 56. In this configuration, the distance between the center of the sleeve 11 and that of the drum 7, i.e., the gap Gp between the sleeve 11 and the drum 7 is maintained constant.

As shown in FIG. 11, an inlet seal cover 60 is retained by the rear and front support members 57 and 58. As also shown in FIGS. 1 and 10, the previously mentioned inlet seal 50 is thin and adhered to the inlet seal cover 60. A shown in FIG. 1, the seal cover 60 is positioned upstream of the developing station between the sleeve 11 and the drum 7 and covers the upper portion of the sleeve 11. The seal cover 60 regulates the developer deposited on the sleeve 11 as well as the stream of air. The inlet seal 50 is formed of, e.g., PET, PUR or similar resin and prevents the toner from flying out of the developing device 10.

As shown in FIG. 11, thin side seals 61 and 62 are formed of resin and respectively adhered to the rear and front support members 57 and 58. The side seals 61 and 62 facing the axially end portions of the sleeve 11 prevent the developer from flying about.

As shown in FIG. 4, the first and second agitator members 44 and 45 respectively have shafts 63 and 64. A plurality of oblong disks 65 and a plurality of oblong disks 66 are respectively mounted on the shafts 63 and 64. The disks 65 and 66 are not shown in FIG. 3 for the sake of clarity. The disks 65 and 66 are each partly cut away. The oblong disks 65 and 66 may be replaced with screws affixed to the shafts 63 and 64, if desired.

The shaft 63 of the agitator member 44 is rotatably supported by a front support wall 67 included in the casing body 3 and the previously stated rear inner wall 54 at its axially opposite ends. The shaft 64 of the agitator member 45 is rotatably supported by the front and rear inner plates 52 and 54 of the unit casing 2 at its axially opposite ends. Drive gears 68 and 69 are respectively affixed to the rear ends of the shafts 63 and 64. Likewise, a drive gear 70 is affixed to the sleeve end member 47. The gears 70, 69 and 68 are held in mesh with each other via intermediate gears, not shown.

An upright partition 71 stands between the agitator members 44 and 45 and extends parallel to the members 44 and 45. The front and rear ends of the partition 71 are notched to form passages 71*a* and 71*b*, respectively.

In the above configuration, when the sleeve end member 47 is rotated by the driving device mounted on the apparatus body, the sleeve 11 is rotated. At the same time, the rotation of the member 47 is transferred to the agitator members 44 and 45 via the drive gears 70, 69 and 68 and intermediate gears. As a result, the agitator members 44 and 45 are each rotated in a preselected direction. The agitator members 44 and 45 each conveys the developer in the chamber 90 in a direction X while agitating it. Consequently, the developer is circulated in the chamber 90 via the passages 71*a* and 71*b* while being guided by the partition 71. This charges each of the toner and carrier of the developer to a particular polarity by friction. The charged developer is fed to the sleeve 11 while the developer from the sleeve 11 is returned to the agitator members 44 and 45. Because the oblong disks 65 and 66 are partly cut away, their cut edges hit against the developer and thereby promote the agitation.

Assuming that the oblong disks 65 and 66 each has a pitch P and a short diameter Y, then the following relation should preferably be satisfied:

$$P=(1/3 \text{ to } 4/3)\times Y.$$

Smaller pitches P would lower the developer conveying ability and would thereby increase the rotation speed of the agitator members 44 and 45, aggravating the deterioration of the developer. Greater pitches P would lower the ability to agitate the developer.

The agitator members 44 and 45 are rotated at the same speed, and their disks 65 and 66 have the same short diameter Y and the same pitch P. The short diameter portions of the disks 65 and 66 should preferably satisfy the following relation:

$$vs=(1.1 \text{ to } 1.5)\times v$$

where vs the peripheral speed of the sleeve 11, and v is the peripheral speed of the short diameter portions.

If the peripheral speed of the disks 65 and 66 is higher than the speed represented by the above equation, then the stress acting on the developer increases. If it is lower than the above speed, then the period of time necessary for the developer on the sleeve 11 to be replaced increases and renders the resulting toner image irregular in density.

The distance between the disks 65 and 66 and the partition 71 or the wall of the development casing should preferably be between 0.5 mm and 2 mm. If the distance is greater than the above range, then the developer partly stays without being surely conveyed. If it is smaller than the above range, then the developer is excessively rubbed against the partition 71 and casing wall and deteriorated in a short period of time.

When the distance between the disks 66 and the sleeve 11 is selected between 1.5 mm and 3 mm, it is possible to feed the developer to the sleeve 11 smoothly and to collect it from the sleeve 11 smoothly. If this distance is excessive, then the developer cannot be sufficiently fed to or collected from the sleeve 11. If it is short, then the developer is rapidly deteriorated due to the stress and cannot be fed in a constant amount.

As shown in FIGS. 1 and 4, a sensor 72 for sensing the toner concentration of the developer 101 is mounted on the development casing 12. In the illustrative embodiment, the sensor 72 senses the toner concentration in terms of permeability. A toner bottle 73 (FIGS. 1 and 2) is removably mounted to the apparatus body.

Assume that the toner concentration of the developer 101 stored in the chamber 90 is lower than a preselected reference level, as determined by the sensor 72. Then, the toner bottle 73 is rotated via its drive shaft 74 in response to the resulting output of the sensor 72. As a result, fresh toner is replenished from a mouth 73*a* included in the bottle 73 into a replenishing section 75 (FIGS. 3 and 4) via an opening 6*a* (FIG. 2) formed in the top wall of the top cover 6. The replenishing section 75 is formed by the casing body 3.

Specifically, a spiral ridge is formed on the inner wall of the toner bottle 73. While the bottle 73 is in rotation, the fresh toner is sequentially driven from the rear toward the front, i.e., mouth 73*a* by the spiral ridge. A hopper, not shown, is disposed between the bottle 73 and the replenishing section 75 in order to guide the fresh toner. The hopper prevents the toner being replenished from the bottle 73 to the replenishing section 75 from flying about. A solenoid-operated clutch, not shown, is mounted on the drive shaft 74 for driving the bottle 74. In response to a toner replenish command, the clutch is coupled to rotate the drive shaft 74.

As shown in FIGS. 3 and 4, a screen plate 76 is interposed between the replenishing section 75 and the chamber 90 and implemented as a thin resin sheet formed with a number of pores. A toner drive member 78 is disposed in the replenishing section 75 and mounted on a shaft 77. A gear 79 is affixed to the shaft 77 and held in mesh with a gear 80 affixed to the shaft 63 of the agitator member 44. The pores of the screen plate 76 have a diameter of about 0.5 mm to 1 min. The shaft 77 is rotatably supported by the casing body 3.

When the agitator member 44 is rotated, its rotation is transmitted to the shaft 77 via the gears 80 and 78. This causes the toner drive member 78 to rotate. When the free edge of the toner drive member 78 slides on the screen plate 76, the toner is driven from the replenishing section 75 into the chamber 90 via the pores of the screen plate 76.

As stated above, the fresh toner replenished form the bottle 73 is once stored in the replenishing section 75 and then driven into the chamber 90 little by little via the pores of the screen plate 76. Therefore, even if the toner is not replenished from the bottle 73 in a constant amount, it is fed to the chamber 90 in a preselected amount at a time. The toner fed to the chamber 90 is agitated together with the developer existing therein by the agitators 44 and 45.

Assume that the sensor 72 continuously senses the short toner concentration of the developer despite the replenishment of the fresh toner. Then, it is determined that the bottle 73 has run out of toner. As a result, a toner near-end condition is displayed to alert the user to the above condition. If the bottle 73 is not replaced despite such an alert, the operation of the entire apparatus is stopped when images are formed on fifty more papers of A4 size.

Whether or not the bottle 73 has been replaced is determined on the basis of the period of time for which a front door, not shown, mounted on the front of the apparatus body has been opened. After the replacement of the bottle 73, fresh toner is continuously replenished from the new bottle for a predetermined period of time. When the output voltage of the sensor 72 shows that the developer has reached the preselected toner concentration, the inhibition of operation of the apparatus is cancelled.

The previously mentioned developer cartridge 81 is mounted on the development casing cover 5 around the opening 102 (FIG. 2). The image forming unit 1 is delivered from, e.g., a factory or a supply station to the user with the bottom opening of the cartridge 81 closed by a flexible seal member, not shown. The cartridge 81 is filled with a two-ingredient type developer, i.e., toner and carrier mixture. At this stage, no developer exists in the chamber 90.

After the delivery of the unit 1 to the user, a roller, not shown, is rotated to take up the seal member, thereby uncovering the bottom of the cartridge 81. As a result, the developer is dropped from the cartridge 81 into the chamber 90. In this manner, the developer is sealed in the cartridge 81 until the unit 1 has been delivered to the user. This prevents the developer from being deteriorated by moisture while the unit 1 is stored, and prevents the developer from leaking from the developing device 10.

Hereinafter will be described the development mechanism using the two-ingredient type developer, particularly the concept of magnet brush development using it.

Electric Field for Development

The electric field E (V/mm) for development formed between the drum 7 and the sleeve 11 shown in FIG. 10 is expressed as:

$$E=\epsilon(Vd-Vb)/Gp \quad (7)$$

where $\in$ is the dielectric constant of the developer, Vd is the potential (V) deposited on the image portion of the drum 7, Vb is the bias voltage (V) for development, and Gp is the gap (mm) between the drum 7 and the sleeve 11.

As the equation (7) indicates, it is possible to control the electric field on the basis of the bias voltage for development. For this reason, for image density control, the bias voltage is varied so as to control the electric field.

Forces Acting on Toner

Figure 12:
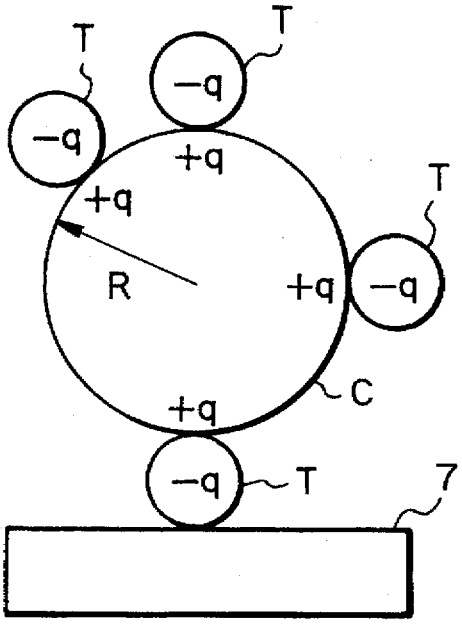
FIG. 12 shows a development model.

FIG. 12 models the adhering force of toner particles T to a carrier particle C. As shown, the toner particles T each exchanges some charges with the carrier particle C due to repeated contact and friction, and therefore has a negative charge −q. A positive charge +q corresponding to the charge −q is deposited on the carrier particle C. An adhering force Ft acting at the point where the toner particle T contacts the carrier particle C consists of a Coulomb's force derived from the charge q and short-distance van der Waals' forces Fv and is expressed as:

$$Ft=Fv+\alpha q^2/4\ \pi\in_o r^2 \tag{8}$$

where r is the radius of the toner particle T, $\in_o$ is the dielectric constant of vacuum, and $\alpha$ is a constant (1 to 1.9) dependent on the dielectric constant of the toner.

The model of insulative magnetic brush development is as follows. Development using the two-ingredient type developer occurs when the driving force (electrostatic force) acting on the toner particle T (q·E) overcomes the adhesion acting between the toner particle T and the carrier particle C:

$$q.E>Fv+\alpha q^2/4\ \pi\in_o r^2 \tag{9}$$

Figure 13:
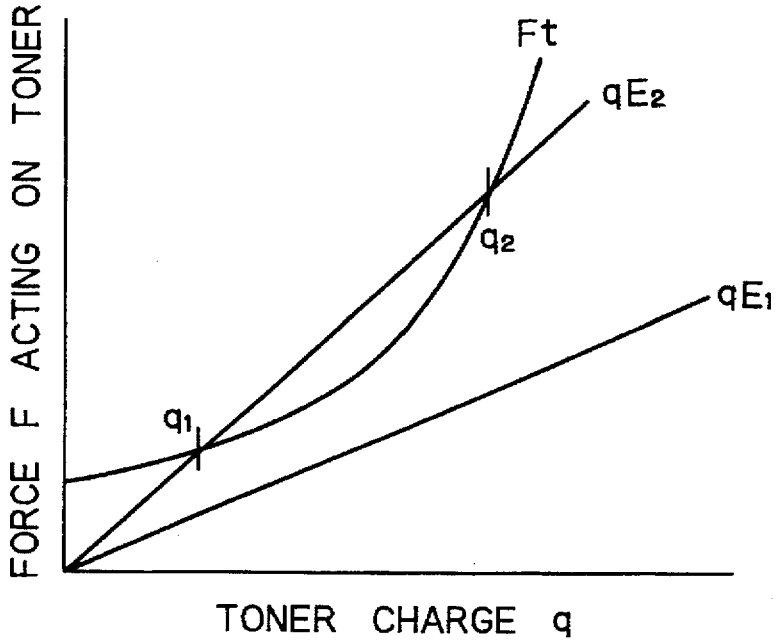
FIG. 13 is a graph showing a specific relation between the toner charge and the force acting on toner.

The above relation (9) will be easily understood when a reference is made to FIG. 13. FIG. 13 shows electric fields $E_1$ and $E_2$ more intense than $E_1$; lines are each representative of the developing force available with the respective electric field. The electric field $E_1$ does not cause development occur. On the other hand, $qE_2$ above an Ft curve extends between $q_1$ and $q_2$, so that all the toner particles whose charges lie in the above range can develop a latent image.

With a conventional image forming unit having at least a photoconductive element and a developing device, a single-ingredient type developer lacking carrier has been predominant over the two-ingredient type developer. In such an image forming unit, a developing sleeve must be located extremely close to the photoconductive element in order to transfer toner particles from the former to the latter, because carrier or similar medium is absent; the gap between them is usually 0 mm to 0.3 mm. Assume that the toner is recycled in the conventional unit the as in illustrative embodiment in order to omit a waste toner tank and other exclusive parts. Then, because the toner deposited on the photoconductive element and then collected by a cleaning device contains paper dust and other impurities, it is likely that the impurities stop up the above small gap and cause white stripes and other defects to appear in images. For this reason, the toner recycling scheme is not feasible for the system using the single-ingredient type developer. Although toner recycling has been practiced with some image forming apparatuses using the single-ingredient type developer, this reduces the life of the image forming unit to only 10K (K=1,000) in terms of the number of copies.

In the illustrative embodiment using the two-ingredient type developer, the gap between the drum 7 and the sleeve 11 can be increased to 0.5 mm or above. Hence, in spite of toner recycling, impurities including paper dust are prevented from stopping up the gap, and the life of the image forming unit is extended to, e.g., 30K in terms of the number of copies which is more than double the life of the conventional unit. This reduces the total cost despite that the carrier increases the cost. In addition, the maintenance cost is reduced because the interval between the replacements of the image forming unit 1 is extended.

The transfer roller or image transferring device 15 is constructed and arranged as follows. The roller 15 has a metallic core and a conductive resin webbing wrapped around the core. In the illustrative embodiment, the roller 15 is constantly biased toward the drum 7 by compression springs, not shown, together with bearings. A constant current is fed to the roller 15 in order to transfer the toner from the drum 7 to the paper. The roller 15, like the charge roller 8, is movable toward and away from the drum 7.

Figure 14:
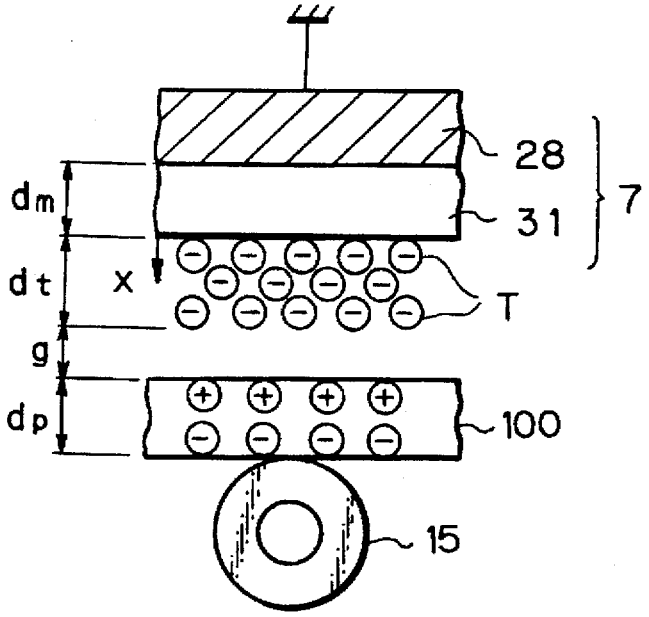
FIG. 14 shows an image transfer model.

The image transfer mechanism will be described with reference to FIG. 14. As shown, a charged toner layer dt having a volume charge density $\rho$ is formed on the drum 7 having the photoconductive layer 31 whose thickness is dm. The paper 100 having a thickness dp is positioned below the toner layer dt. The toner layer dt and paper 100 are spaced from each other by a gap g. A charge crc opposite in polarity to the charged toner dt is deposited on the paper 100. Under these conditions, assume the toner particles T spaced from the surface of the drum 7 by a distance x and having a charge qt. Then, a force Fe(x) acting on the particles T is expressed as:

$$Fe(x)=qt\{-\sigma c-\rho(dt-x)\}/(\in_o\cdot Kt) \tag{10}$$

where $\in_o$ is the dielectric constant of vacuum, and Kt is the specific inductive capacity of the toner layer.

Assume that the electrostatic force Fe(x) acting on the charged toner T located at the distance x balances with the mechanical adhering force Fa, that the toner layer is divided into two at such a point, and that only the toner layer having a thickness (dt−x) is transferred to the paper 100. Then, the transfer ratio $\eta$ is produced by:

$$\eta=(dt-x)/dt=\int o^1-1/(\rho\cdot dt)\{\sigma c+(\in_o\cdot Kt)Fa/qt\} \tag{11}$$

As for the equation (10), assuming that the toner has a density $\delta$, and that the charged toner layer has a packing ratio p and a specific charge Tp, then the volume charge density $\rho$ is expressed as $\rho=\delta\cdot p\cdot Tp$. Also, assuming that a single toner particle has a mass m, then the charge qt of the toner is expressed as qt=Tp·m. Therefore, the equation (10) may be rewritten as:

$$Fe(x)=\{-\sigma c\cdot m\cdot Tp-\delta\cdot m(dt-x)Tp^2\}/(\in_o\cdot Kt) \tag{12}$$

The above equations are transfer model equations.

Figure 15:
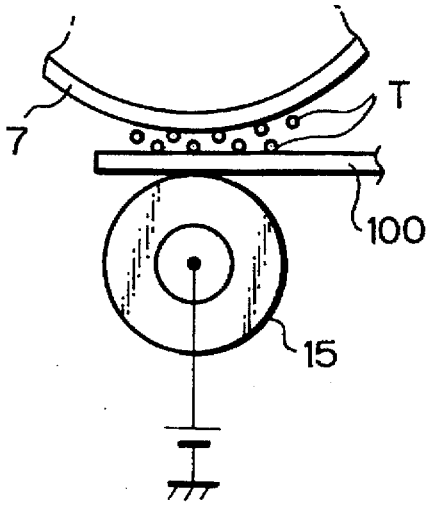
FIG. 15 shows a relation between the photoconductive element and a transfer roller.
Figure 16:
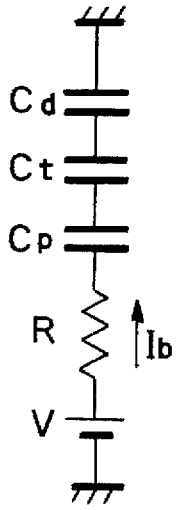
FIG. 16 shows an equivalent circuit associated with FIG. 15.

Hereinafter will be described control over the image transfer from the drum 7 to the paper 100. FIGS. 15 and 16 show a transfer model assuming that the paper 100 is of maximum size available with the apparatus, and that the toner is present. A transfer current Ib in the image portion of the drum 7 is produced by:

$$Ib=(V-V1)/(R+Zb) \tag{13}$$

where Zb is equal to (1/Cd+1/Cp+1/Ct), Cd is equal t o $K_o\cdot Kd\cdot L\cdot Vp/d$, Cp is equal to $K_o\cdot Kp\cdot L\cdot Vp/dp$, Ct is equal to $K_o\cdot Kt\cdot L\cdot Vp/dt$, V is the transfer voltage, V1 is the surface potential of the image portion, R is the resistance of the transfer roller 15, $K_o$ is the dielectric constant, Kd is the specific inductive capacity of the photoconductive layer 31, Kp is the specific inductive capacity of the paper 100, Kt is the specific inductive capacity of the toner layer, d is the thickness of the layer 31, dp is the thickness of the paper 100, dt is the thickness of the toner layer, L is the width of the paper 100, and Vp is the peripheral speed of the drum 7.

When the respective values are substituted for the equation (13), the term V−V1 is expressed as:

$$V-V1=I\cdot R+(Ib\cdot dp)/(K_o\cdot Kp\cdot L\cdot Vp)+(Ib\cdot dt)/(K_o\cdot Kt\cdot L\cdot Vp)+(Ib\cdot d)/(K_o\cdot Kd\cdot L\cdot Vp) \quad (14)$$

Assuming that the image transfer is controlled by the constant current system, then the transfer charge σc described in relation to the image transfer mechanism is equal to the term Ib/L·Vp of the equation (14) and relating to the paper 100. Hence, by controlling the image transfer such that the current Ib remains constant, it is possible to apply a stable charge current at all times.

As for the constant voltage control system, assume that the transfer voltage V of the equation (14) is constant. Then, when the resistance R of the roller 15 increases due to a noticeable change in environment, the voltage of the roller section increases with the result that the voltage to be applied to the paper 100 decreases. The resulting variation in transfer charge prevents stable image transfer conditions from being set up. Therefore, the constant current control is advantageous over the constant voltage control when it comes to the variation of the resistance of the roller 15.

Figure 17:
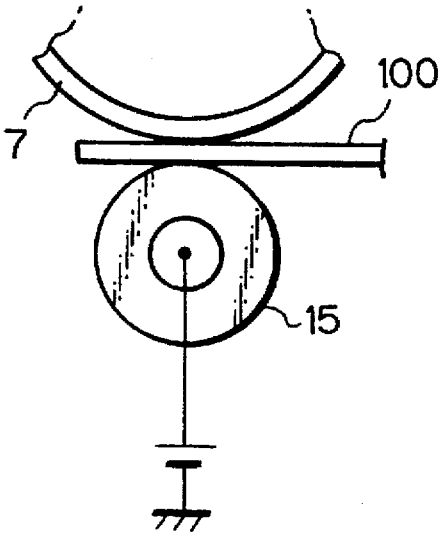
FIG. 17 shows a relation between the photoconductive element, transfer roller, and paper.
Figure 18:
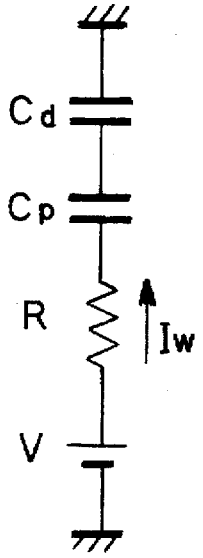
FIG. 18 shows an equivalent circuit associated with FIG. 17.
Figure 19:
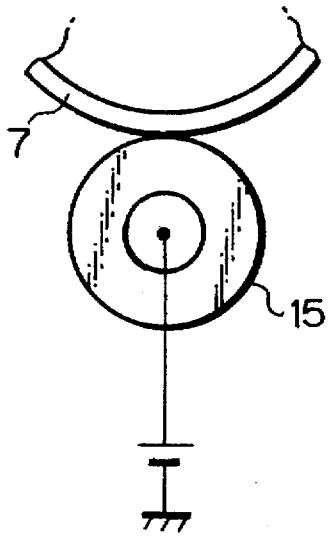
FIG. 19 shows a relation between the photoconductive element and the transfer roller.
Figure 20:
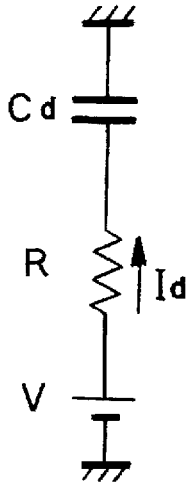
FIG. 20 shows an equivalent circuit associated with FIG. 19.

Assume that the paper 100 is present, but the range in which the toner is present is narrow, as shown in FIGS. 17 and 18, or that the drum 7 and transfer roller 15 directly contact each other over a substantial range due to a small paper size, as shown in FIGS. 19 and 20. A current Iw flowing in the condition shown in FIGS. 17 and 18 is produce by:

$$Iw=(V-Vd)/(R+Zw) \quad (15)$$

where Zw is equal to (1/Cd+1/Cp).

A current Id flowing in the condition shown in FIGS. 19 and 20 is produced by:

$$Id=(V-Vd)/(R+Ze) \quad (16)$$

where Zd is equal to (1/Cd), and Vd is the surface potential of the non-image portion or background of the drum 7.

In the case of constant current control, when a paper of small size, e.g., A6 is passed, much of the current flows into the drum 7. Consequently, a sufficient current Ib is not attainable, resulting in defective image transfer. In light of this, an arrangement may be made such that the resistance of the roller 15 is measured, and then a voltage matching the measured resistance and capable of providing an adequate transfer charge is applied. This kind of scheme will be described specifically. Assume that a voltage $V_t$ causes a current $I_1$ to flow when an image forming operation is not performed. Then, the current $I_1$ is expressed as:

$$I_1=(V_1-Vd)/(R+Zd) \quad (17)$$

where Vd is the charge potential and known beforehand.

From the equation (17), the resistance R of the roller 15 is produced by:

$$R=1/I_1\cdot\{V_1-Vd-(I_1\cdot Id)/Cd\} \quad (18)$$

where Cd is the capacitance of the photoconductive layer and also known beforehand.

Assume that the voltage allowing Ib to reach a n adequate current $I_2$ at the time of image formation is $V_2$, then there holds an equation:

$$I_2=(V_2-V_1)/(R+Zb) \quad (19)$$

By substituting the equation (18) for the equation (19), the voltage $V_2$ is produced by:

$$V_2=(I_2/I_1)\times(V_1-Vd)+I_2(Zb-Zd)+V_1 \quad (20)$$

If the voltage $V_2$, as distinguished from $V_1$, produced by the above equation (20) is applied during the course of image formation, then the image can be transferred by an adequate voltage V matching the resistance R of the roller 15 at all times.

The influence of the linear velocity of the drum 7 is as follows. To see the relation between the peripheral speed Vp of the drum 7 and the resistance R of the roller 15, the equations (13), (14) and (15) are rewritten to produce R, as follows:

$$R=(V-V_1)/(Qb\cdot L\cdot Vp)-Yb/Vp \quad (21)$$

$$R=(V-Vd)/(Qw\cdot L\cdot Vp)-Yw/Vp \quad (22)$$

$$R=(V-Vd)/(Qd\cdot L\cdot Vp)-Yd/Vp \quad (23)$$

where Yb/Vp is equal to 1/Cd+1/Cp+1/Ct, Yw/Vp is equal to 1/Cd+1/Cp, Yd/Vp is equal to 1/Cd, and Qb, Qw and Qd are respectively the charges of the image portion, non-image portion and non-paper portion for a unit area, i.e., Qb=Ib/L·Vp, Qw=Iw/L·Vp, and Qd=Id/L·Vp.

It will be seen that when the peripheral speed of the drum 7 is changed, the resistance of the roller 15 should only be changed in inverse proportion to the peripheral speed.

In the equation (16), the term relating to the discharge start voltage (Vg) and stated in relation to the charge mechanism of the charge roller 8 is omitted. This is because Vg is expressed as $312+6.2\times d/Kd+\sqrt{(7737.6\times d/Kd)}$ and can be regarded as a substantially constant value determined by the thickness d and specific inductive capacity Kd of the photoconductive layer.

In the cleaning device 17 shown in FIG. 1, the cleaning blade 18 is a flat member formed of polyurethane rubber or similar elastic material. The blade 18 is affixed to a metallic blade holder 82 by adhesive or two-sided adhesive tape. As also shown in FIG. 3, two positioning pins 83 are studded on an inclined surface 84 included in the casing body 3. The blade holder 82 is restricted by the pins 83 as to its movement parallel to the inclined surface 84. In addition, the blade holder 82 is affixed to the casing body 3 by screws 85 in the direction opposite to the direction of rotation of the drum 7. The screws 85 cause the blade holder 82 to follow the configuration of the inclined surface 84 in the same direction as the surface to which the blade 18 is adhered. As a result, the blade 18 is restricted in position in the direction perpendicular to the inclined surface 84.

By the above configuration, the angle and pressure with which the blade 18 contacts the drum 7 are guaranteed. This obviates defective cleaning, noise and other undesirable occurrences. The positions of the screws 85 in the thrust direction may be outboard of the opposite ends of the drum 7 inclusive of the flanges 86 and 87. Then, only the blade 18 can be replaced with the drum 7 left in the assembly.

A device for recycling the toner and also included in the apparatus will be described hereinafter. The toner scraped off the drum 7 by the cleaning blade 18 shown in FIGS. 1 and 3 is conveyed to the front of the cleaning case 19 by a toner conveyor member 20. Then, the toner is delivered to the outside of the casing 19 via a pipe 88 protruding from the casing 19. A gear, not shown, is affixed to the rear end of the conveyor member 20 and held in mesh with the gear formed integrally with the rear flange 87 of the drum 7. In this condition, the rotation of the drum 7 is transferred to the conveyor member 20.

Figure 21:
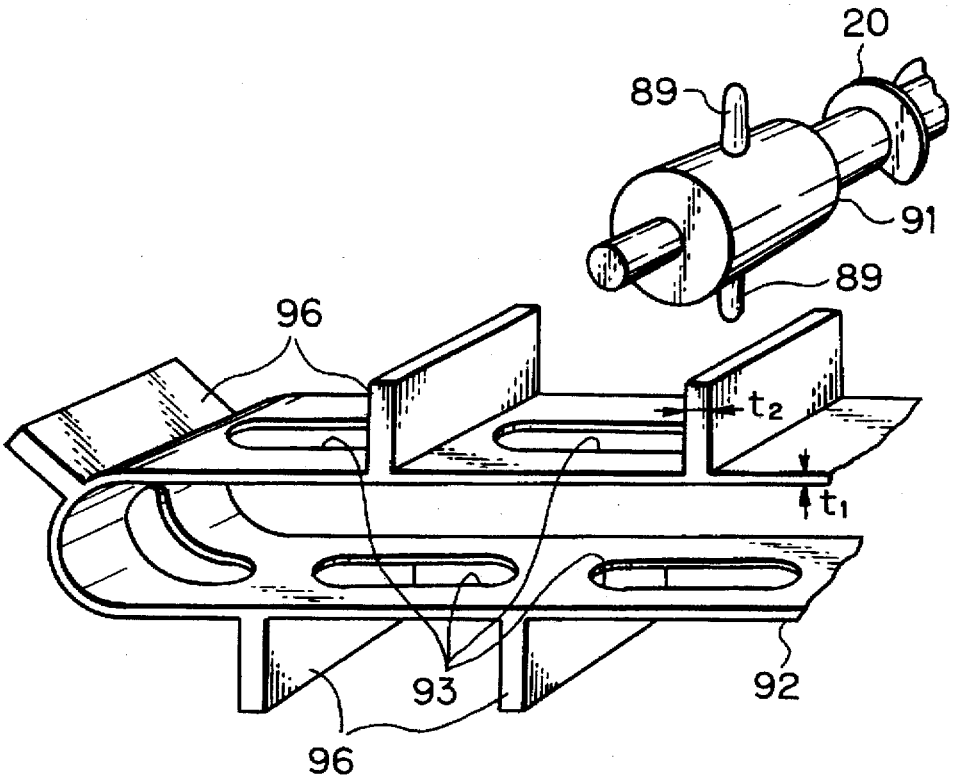
FIG. 21 is an enlarged perspective view of a toner recycle belt.
Figure 22:
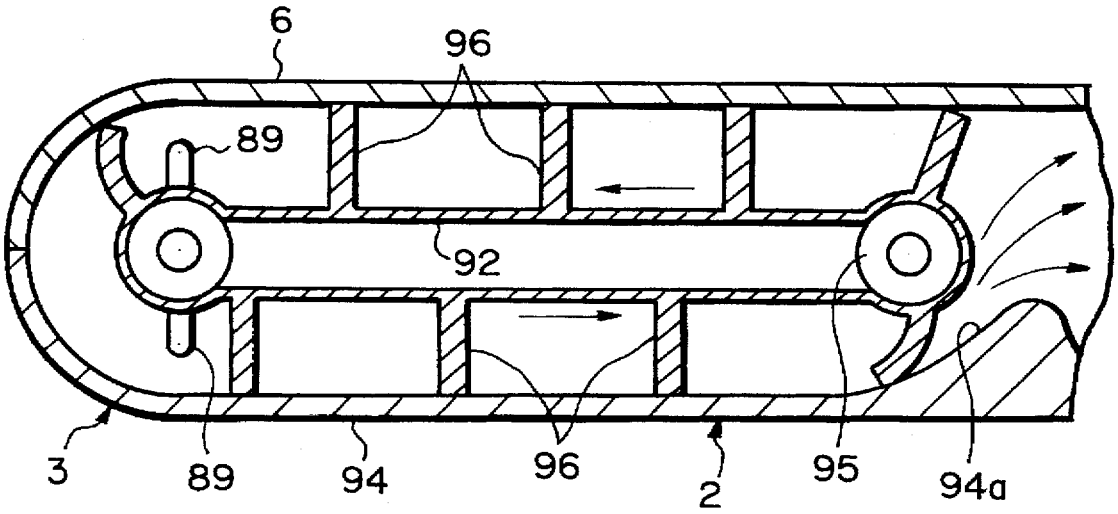
FIG. 22 is a vertical section of the toner recycle belt.

As shown in FIGS. 3, 21 and 22, the front end of the conveyor member 20 protruding from the casing 19 is implemented as a roller 91. A pair of pins 89 are studded on the roller 91. A toner recycle belt 92 is passed over the roller 91. A number of slots 93 having the same length are formed in the belt 92 at equally spaced locations along the circumference of the belt 92. The pins 89 are each received in any one of the slots 93. As shown in FIG. 3, the belt 92 is located in the previously mentioned toner conveyance path formed in a trough portion 94 which is formed by a part of the casing body 3. The top of the path is closed by the top cover 6 (see also FIG. 2), as stated earlier.

As shown in FIGS. 3 and 22, the belt 92 is also passed over a driven roller 95 rotatably disposed in the trough portion 94. When the conveyor member 20 is rotated, it causes the pins 89 of the roller 91 to sequentially enter the slots 93 of the belt 92. As a result, the belt 92 is driven in a direction indicated by an arrow in FIG. 22. A number of elastic fins 96 protrude from the outer periphery of the belt 92 and are spaced from each other in the circumferential direction of the belt 92. While the belt 92 is in rotation, the fins 96 slide on the inner periphery of the trough portion 94 and that of the top cover 6.

While the toner driven out of the casing 19 by the conveyor member 20 moves unstably around the portion where the casing 19 adjoins the belt 92, it is dropped into the trough portion 94 via the slots 93 of the belt 92. Then, the fins 96 convey the toner to the chamber 90 of the developing device 10 along the toner conveyance path. Because the fins 96 are pressed against the inner periphery of the trough portion 94, they surely convey all the toner to the chamber 90 without exerting an excessive stress on the toner.

The inner periphery of the trough portion 94 includes an inclined surface 94*a* adjoining the driven roller 95. The fins 96 are each elastically deformed when sliding on the inclined surface 94*a*, and then sprung back on leaving it. As a result, the toner conveyed by the fin 96 is sent toward the second agitator member 45 (FIG. 4). In this manner, the toner is surely conveyed to the chamber 90, mixed with the developer existing in the chamber 90, and then used again for development.

As shown in FIG. 21, assume that the belt 92 has a thickness $t_1$ while the fins 96 each has a thickness $t_2$. Then, the thickness $t_2$ is selected to be smaller than the thickness $t_1$, i.e., the fins 96 have greater elasticity than the belt 92. This successfully enhances the function assigned to the ribs 96.

With the above toner recycling device, it is possible to omit a waste toner tank otherwise needed to store the toner collected from the drum 7. The toner collected from the drum 7 can be efficiently reused by the developing device 10.

The trough portion 94 is formed by a part of the casing body 3, as stated above. If the trough portion 94 is implemented as a member independent of the casing body 3, the toner is apt to leak through the clearance between them. Further, the trough portion 94 does not need a sponge or similar seal member for preventing the toner from leaking. In addition, the trough portion 94 and casing body 3 formed integrally with each other promote the easy assembly of the image forming unit 1.

The drive gears 68 and 69 are respectively unmovably mounted on the rear ends of the shafts 63 and 64 of the agitator members 44 and 45, as stated previously. With this kind of arrangement, it has been customary to fit E-rings, C-rings or similar stops on the shafts in order to prevent the gears from slipping off the shafts. However, such stops increase the number of parts and cost.

By contrast, in the configuration shown in FIGS. 3 and 4, the rear outer plate 53 of the unit casing 2 is positioned outside of the drive gears 68 and 69. The plate 53 plays the role of a stop for preventing the gears 68 and 69 from slipping off the shafts 63 and 64 in the axial direction. Specifically, the casing body 3 has the rear inner plate 54 rotatably supporting the shafts 63 and 64 and the rear outer plate 53 positioned outside of the plate 54. The gears 68 and 69 are positioned between the plates 53 and 54. The plate 53 prevents the gears 68 and 69 from slipping off the shafts 63 and 64. The top of the space in which the gears 68 and 69 are positioned is closed by a part of the development casing cover 5. This reduces the number of parts and cost.

Further, because the gears 68 and 69 are disposed in the closed space between the two plates 53 and 54, the operator is prevented from touching them. In addition, such a double wall structure of the casing body 3 more positively prevents the developer from leaking from the developing device 10 to the outside of the unit 1. Specifically, even if some developer leaks via the inner plate 54 and the rear side wall 5*a* (FIG. 1) of the casing cover 5 to the outside of the chamber 90, it is intercepted by the outer plate 53.

Figure 23:
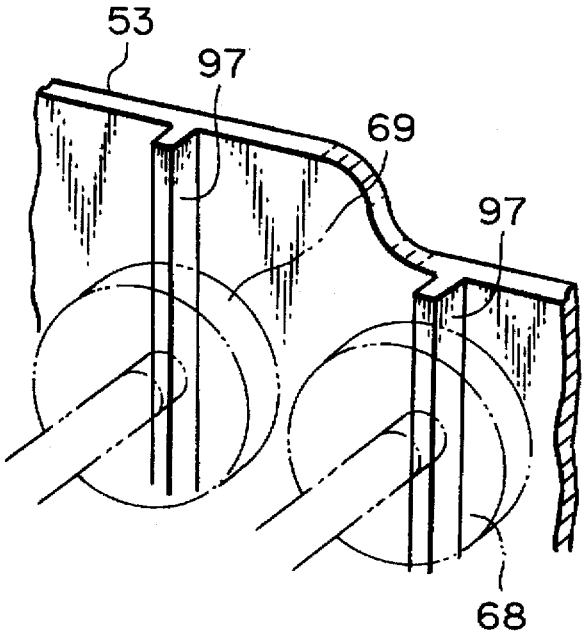
FIG. 23 is a perspective view showing another configuration of a rear outer plate of a unit casing.
Figure 24:
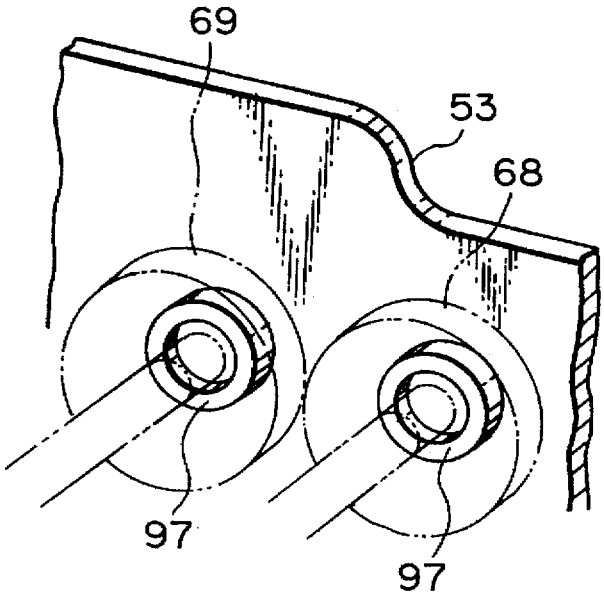
FIG. 24 is a perspective view showing still another configuration of the rear outer panel.

As shown in FIG. 23 or 24, projections 97 in the form of ribs or cylinders may be formed on the portions of the rear outer plate 53 facing the drive gears 68 and 69, respectively. Then, the end faces of the gears 68 and 69 contact the projections 97 each having only a small area. In this configuration, friction acting between the gears 68 and 69 and the plate 53 is reduced to in turn reduce the torque for driving the gears 68 and 69. In addition, the wear of the gears 68 and 69 and unit casing 2 is reduced.

The above arrangement in which a casing portion contacting gears is located outside of the gears and prevent the gears from slipping off the respective shafts is applicable not only to an image forming unit but also to any other kind of machine and apparatus.

Figure 25:
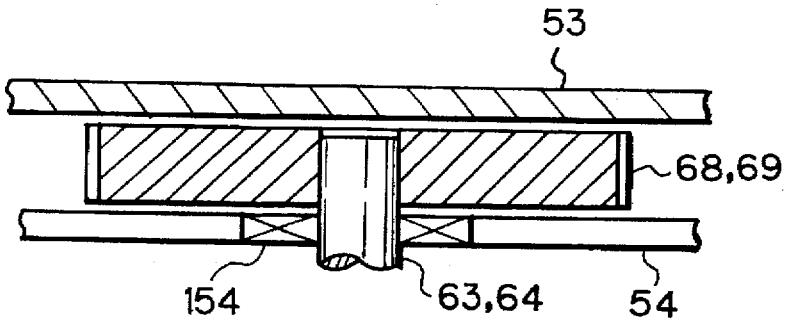
Figure 26:
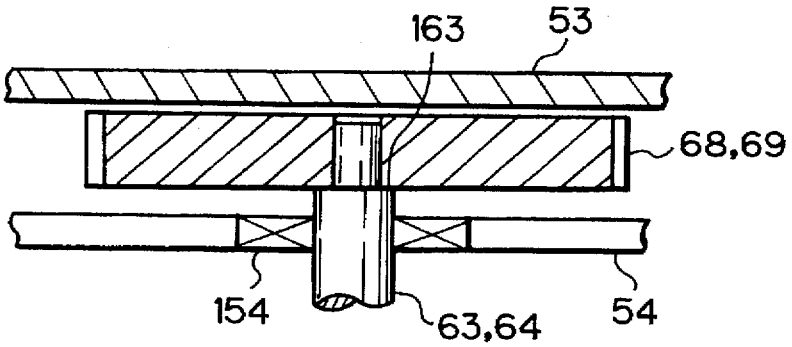
Figure 27:
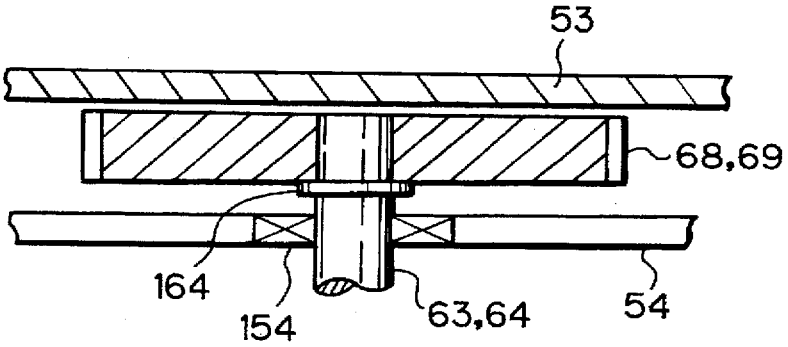

FIGS. 25, 26 and 27 each shows a specific implementation for preventing the drive gears 68 and 69 from being displaced inward in the axial direction of the shafts 63 and 64. In FIG. 25, the gear 68 or 69 is prevented from moving in the above direction by at least one of the rear inner wall 54 and a bearing 154 mounted thereon. In FIG. 26, the shaft 63 or 63 is formed with a shoulder 163 in order to stop the gear 68 or 69. In FIG. 27, an E- or C-ring 164 prevents the gear 68 or 69 from moving in the above direction.

The image forming apparatus described above consists of a number of devices and stores the two-ingredient type developer 101 in its developing chamber 90. The individual device is deteriorated due to aging until it becomes unusable. Usually, the individual device is replaced with a new device when or just before it becomes unusable. This is the end of the life of the device. If the various devices each has a different life, then the individual device must be replaced independently of the other devices, resulting in troublesome replacement. Stated another way, if all the devices are so configured as to have substantially the same life, then they can be collectively replaced when the life ends by a simple operation.

However, no consideration has heretofore been given to the relation between the life of the carrier included in the developer and the life of the other image forming devices. Hence, the developer has customarily been replaced alone when its carrier has been deteriorated.

In the illustrative embodiment, the drum or image carrier 7 and the carrier of the developer 101 are provided with the same life. When the life of the drum 7 and developer 101 ends, they are replaced at the same time.

Further, in the embodiment, the drum or image carrier 7 and sleeve or developer carrier 11 are assembled together on the unit casing 2, thereby constituting the image forming unit 1. The developer 101 is stored in the development casing 12 formed by a part of the unit casing 2. Therefore, the replacement of the entire unit 1 to be effected when the life of the drum 7 and carrier ends does not increase the user's economic burden. The replacement of the entire. unit 1 can be easily done. In addition, because the casing 12 of the developing device 10 is constituted by the unit casing 2, the cost of the entire unit 1 is reduced. This further reduces the user's economic burden.

If not only the life of the drum 7 but also the life of the charge roller or charging device 8 and that of the cleaning blade or cleaning member 18 are coincident with the life of the carrier, all of them can be replaced at the same time when the life ends. In the illustrative embodiment, the drum 7, charger roller 8, sleeve 11 and cleaning blade 18 are constructed into a single image forming unit 1, while the developer 101 is stored in the casing 12 formed by a part of the unit casing 2. Hence, the unit 1 can be bodily replaced when their life ends, while further reducing the user's burden.

Furthermore, in the embodiment, the toner removed from the drum 7 by the cleaning device 17 is returned to the developing device 10 by the toner recycling device, so that the toner is again used for development. This reduces the user's burden and frees, even when the entire unit 1 is replaced, the user from excessive burdens. In addition, the toner conveyance path of the recycling device is formed by a part of the unit casing 2. This effectively prevents the cost of the unit 1 from increasing.

The life of the individual constituent of the image forming unit 1 may be set as follows. Assume that the individual constituent reaches the end of its life just before it becomes unusable.

First, the life of the developer, more precisely its carrier, is determined as the coating layer of the carrier is sequentially peeled off due to repeated agitation and circulation, deteriorating the frictional charging characteristic of the carrier. Specifically, the life of the developer 101 can be roughly set on the basis of the thickness of the coating layer and the total amount of the developer 101 stored in the chamber 90.

The life of the drum 7 is determined as its photoconductive layer 31, among others, is sequentially shaved off by the cleaning blade 18 until the layer 31 becomes too thin to set up an adequate charge potential. Specifically, the life of the drum 7 can be roughly set on the basis of the thickness of the layer 31.

The life of the cleaning blade 18 is determined by the pressure with which the blade 18 contacts the drum 7, and the wear of the edge of the blade 18 contacting the drum 7. Generally, the ability of the blade 18 to remove the toner from the drum 7 decreases with an increase in the wear of the blade edge. However, although an increase in the contact pressure of the blade 18 acting on the drum 7 accelerates the wear of the blade 18, it enhances efficient cleaning and thereby extends the life of the blade 18. Of course, a high contact pressure would increase the lead torque of the drum 7. It follows that the life of the blade 18 can be roughly set on the basis of the contact pressure of the blade 18 acting on the drum 7.

The life of the charge roller 8 is dependent on the pressure with which the cleaning pad 32 (FIG. 1) presses the charge roller 8 for removing fine toner particles from the roller 8. Specifically, although a high pressure enhances the efficient cleaning of the roller 8, it produces scratches on the surface of the roller 8 and results in defective images. A low pressure lowers the cleaning ability of the pad 32. Hence, the life of the roller 8 can be roughly set on the basis of the pressure of the pad 32 acting on the roller 8.

Figure 28:
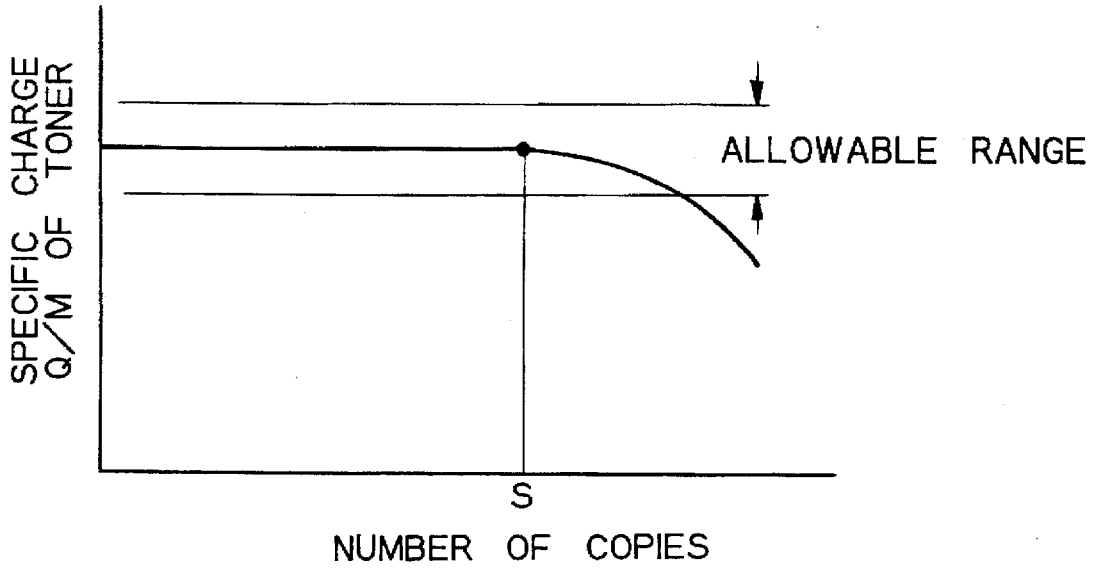
FIG. 28 is a graph showing a specific relation between the number of copies and the specific charge of toner.

How the life of the drum 7 and that of the carrier of the developer 101 are brought into coincidence will be described specifically. Assume that the common life of the drum 7 and developer 10 ends when S copies each carrying a toner image have been produced, and then the image forming unit 1 is bodily replaced. Then, as for the developer 101, the thickness of the carrier coating layer and the amount of the developer are selected such that the frictional charging characteristic of the carrier is critically deteriorated just after S copies have been produced. The frictional charging characteristic of the carrier can be represented by the specific charge of the toner (amount of charge per unit weight Q/M). FIG. 28 shows a relation between the specific charge of the toner and the number of copies produced. As shown, when the specific charge Q/M decreases below an allowable range, an image has its background contaminated or has its density reduced. The thickness of the carrier coating and the amount of the developer 101 are selected such that S copies are produced just before the above condition occurs.

For example, assume that the above number S is 30K, 40K or 50K (K=1,000). Then, the carrier coating thickness and the amount of the developer 101 are selected such that the specific charge Q/M remains in the range of from 10 μc/g to 40 μc/g until the 30K, 40K or 50K papers have been produced, but decreases below the above range just after more than such a number of copies have been output. This allows the life of the developer to be accurately set. Specifically, the thickness of the coating layer is selected to be 0.5 μm to 1.5 μm while the amount (weight) of the developer 101 is selected to be 2.45N to 4.41N. The cost decreases with a decrease in the amount of the developer 101. In light of this, it is preferable that the amount of the developer 101 be combined with the thickness of the coating layer such that it decreases with a decrease in the set number of copies, i.e., the set life of the developer 101.

As for the drum 7, the thickness of the photoconductive layer 31 is also set such that an adequate charge current becomes unavailable just after S copies have been produced. For example, assume that the charge potential varies over a range of less than 20 V due to the varying thickness of the layer 31 ascribable to aging. Then, the thickness of the layer 31 should only be selected such that, in the equations shown in relation to the charge mechanism of the charge roller 8, the discharge start voltage (charge start voltage) Vg susceptible to the varying thickness of the layer 31 does not vary by more than 20 V. Assume that the layer 31 wears by an amount l known beforehand when S copies are produced. Also, assume that the layer 31 has an initial thickness d and a specific inductive capacity Kd, that the initial charge start voltage is Vgs, and that the charge start voltage after the production of S copies is Vge. Then, the following equations hold:

$$Vgs = 312 + 6.2 \times d/Kd + \sqrt{(7737.6 \times d/Kd)}$$

$$Vge = 312 + 6.2 \times (d - l)/Kd + \sqrt{\{7737.6 \times (d - l)/Kd\}}$$

$$Vgs - Vge = 1.931 + 49.17\{\sqrt{d} - \sqrt{(d - l)}\}$$

If l is 3 μm by way of example, then there holds:

$$Vgs - Vge = 5.79 + 49.17\{(\sqrt{d} - \sqrt{(d-3)}\}$$

Assuming that the range of variation is less than 20 V, then there holds:

$$Vgs - Vge = 5.79 + 49.17\{\sqrt{d} - \sqrt{(d-3)}\} \leqq 20$$

$$\sqrt{d} - \sqrt{(d-3)} \leqq 0.289$$

Assuming that $\sqrt{d}=D$ and $d-3=D^2-3$, then there holds:

$$D - \sqrt{(D^2-3)} \leqq 0.289$$

$$\sqrt{(D^2-3)} \leqq D - 0.289$$

Squaring the two sides of the above relations, there are obtained:

$$D^2-3 \leqq D^2-0.578D+0.0835$$

$$0.578D \leqq 3.0835$$

Therefore, $$D \leqq 5.33.$$

From $\sqrt{d}=D$, $d=D^2$ holds, and therefore, $$d=5.332=28.4\ \mu m$$

Therefore, assuming that the layer 31 wears by 3 μm when S copies are produced, then the range of variation can be maintained lower than 20 V if the initial thickness of the layer 31 is selected to be 28.4 μm.

For example, to cause the life of the drum 7 to end when 30K copies are produced, the thickness of the layer 31 is selected such that the voltage drop ascribable to the variation of the thickness is less than 20 V until 30K copies have been produced, but becomes greater than 20 V just after more than 30K copies have been produced. If the layer 31 wears by 2 μm after the production of 30K copies, then the initial thickness is about 13 μm as determined by the above equations. Likewise, if the life of the drum 7 should end on the production of 40K copies, then the initial thickness is selected to be about 20 μm because the wear of the layer 1 is 2.5 μm. Further, if the life of the drum 7 is coincident with the production of 50K copies, then the initial thickness is selected to be about 28.4 μm because the wear of the layer 31 is 3 μm.

With the above scheme it is possible to bring the life of the developer and that of the drum 7 into coincidence, and therefore to replace the entire image forming unit 1 at the same time. This noticeably reduces the maintenance cost, compared to the case wherein each constituent part is replaced at a particular timing.

FIG. 28 shows a relation between the contact pressure of the cleaning blade 18 acting on the drum 7 and the wear of the blade 18. As FIG. 28 indicates, to end the life of the blade 18 on the production of S copies, the above pressure is selected such that when the pressure is low, defective cleaning does not occur until S copies have been produced, but occurs just after more than S copies have been produced. This is also true when the pressure of the blade 18 is high.

Figure 29:
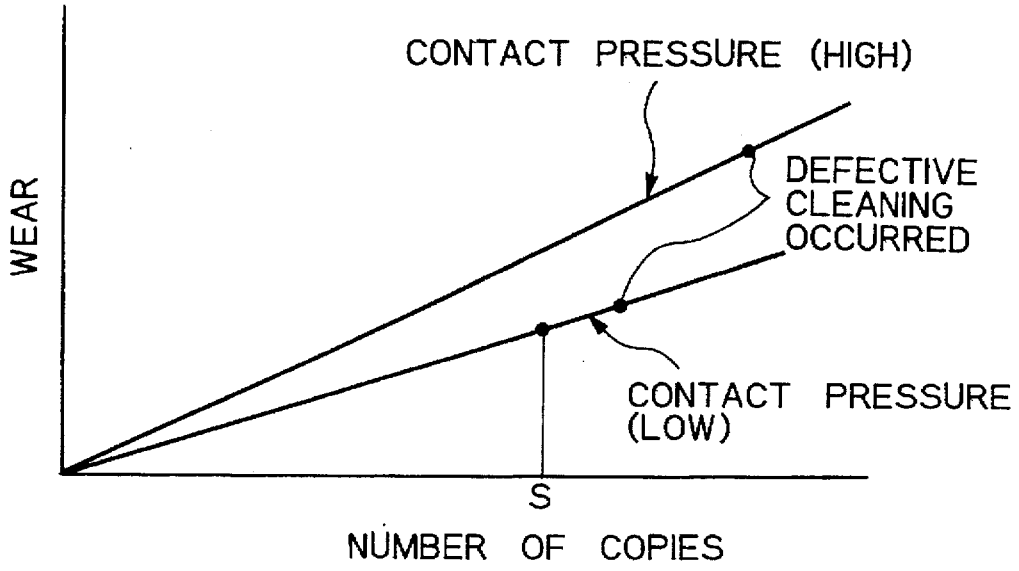
FIG. 29 is a graph showing a specific relation between the number of copies and the wear of a cleaning blade.

FIG. 29 clearly shows that when the pressure is high, the wear of the blade 18 is accelerated, but the number of copies throughout which the blade 18 can clean the drum 7 in a desirable condition increases, i.e., the life of the blade 18 is extended. However, the high pressure increases the load torque of the drum 7 and therefor the load acting on a drive motor. As a result, a drive motor having a great capacity is required which increases the cost of the apparatus. In the cost aspect, therefore, the contact pressure of the blade 18 should not be excessively high.

As stated above, the life of the blade 18 can be set and brought into coincidence with the life of the developer. This allows the blade and developer to be replaced at the same time and thereby further reduces the maintenance cost. For example, when the life of the developer and drum 7 is coincident with the production of 30K copies, the contact pressure of the blade 18 is selected to be about 0.1176N/cm. If the life ends on the production of 40K copies, then the contact pressure is selected to be about 0.1568N/c m. Further, if the life ends on the production of 50K copies, then the contact pressure is selected to be about 0.196N/cm.

Figure 30:
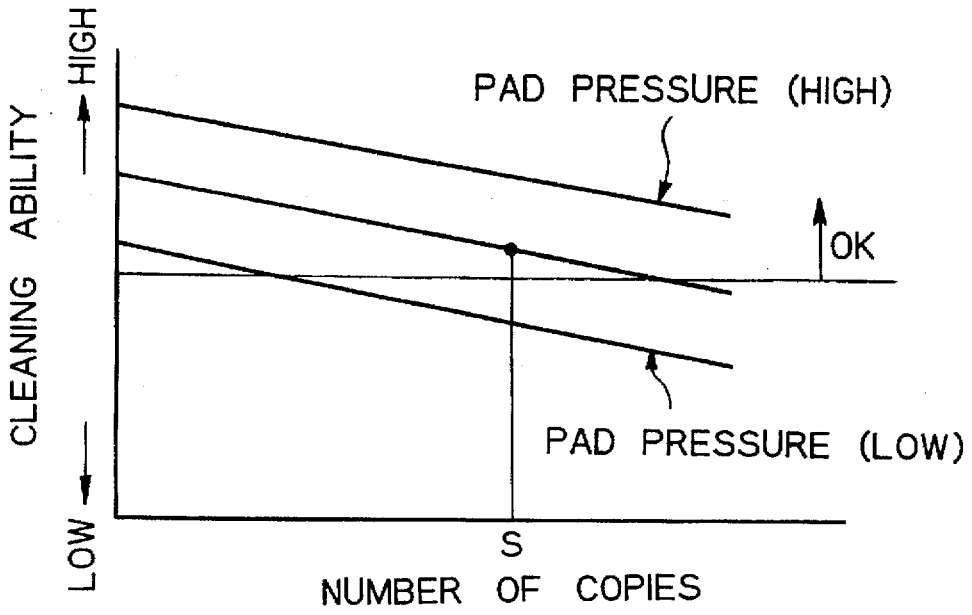
FIG. 30 is a graph showing a specific relation between the number of copies and the ability to clean the charge roller.
Figure 31:
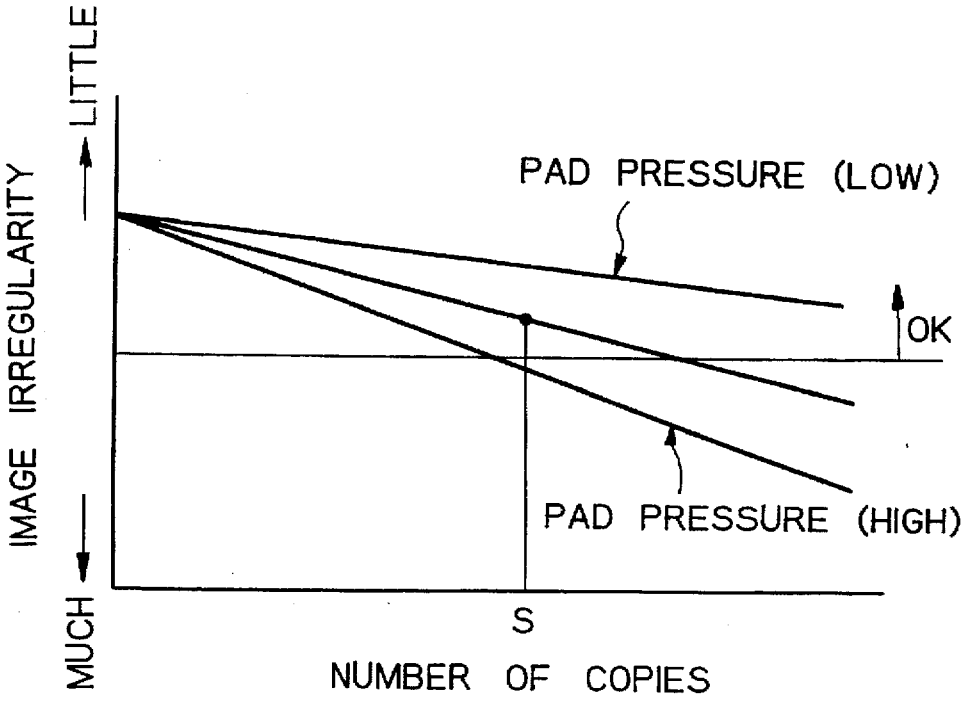
FIG. 31 is a graph showing a specific relation between the number of copies and the irregularity of an image.

To end the life of the charge roller 8 on the production of S copies, the roller 8 is configured as follows. FIG. 30 shows a relation between the contact pressure of the cleaning pad 32 acting on the charge roller 8 and the cleaning ability of the pad 32. FIG. 31 shows a relation between the contact pressure of the pad 32 and the image irregularity ascribable to scratches formed on the roller 8. In ranges labeled OK in FIGS. 30 and 31, the pad 32 desirably cleans the charge roller 8 and frees images from critical irregularity.

As FIGS. 30 and 31 indicate, the pad pressure is selected such that the cleaning ability of the pad 32 remains high enough to protect images from irregularity until S copies have been produced, but becomes defective and renders images irregular just after more than S copies have been produced. In this manner, the developer 101, drum 7, cleaning blade and charge roller 8 are all brought into coincidence as to their life.

For example, to end the life of the roller 8 on the production of 30K copies, the pressure of the pad 32 is selected to be about 5.88N. If the life of the roller 8 should end on the production of 40K copies, then the pad pressure is selected to be about 7.84N. Further, if the life of the roller 8 should end on the production of 50K copies, then the pad pressure is selected to be about 9.8N. Preferably, the pad pressure should also be relatively low so long as it satisfies the cleaning ability required of the pad 32. The low pad pressure reduces the torque for driving the drum 7, the capacity required of a drive motor, and the cost.

As stated above, the drum 7, developer 101, cleaning blade 18 and charge roller 8 assembled together on the unit casing 2 have their materials and characteristic values set such that their lives end at the same time when a preselected number of copies are produced. Therefore, the image forming unit 1 is far more cost-effective and waste-saving than conventional units. In addition, because the unit 1 should only be bodily replaced, efficient maintenance is promoted and reduces the maintenance cost to a significant degree. If use can be made of inexpensive and highly durable parts, such parts may have their lives changed individually.

In the above embodiment, the developing device, cleaning device and charge roller which are specific image forming devices are mounted on a single unit casing. Alternatively, such image forming devices or other image forming devices may be suitable combined such that at least one image forming device is mounted on the unit casing. In many cases, at least the photoconductive element and developing device are assembled together on the unit casing. This kind of scheme promotes easy assembly and easy replacement. Further, the present invention is applicable even to an image forming apparatus in which a plurality of image forming devices are not constructed into a single image forming unit.

In summary, it will be seen that the present invention provides an image forming apparatus having various unprecedented advantages as enumerated below.

(1) A carrier contained in a developer and an image carrier can be replaced at the same time. Therefore, the replacement is easy and reduces the maintenance cost to a significant degree.

(2) When the carrier and image carrier reach the end of their life, the entire image forming unit is replaced with a new unit. This can be done without increasing the user's economic burden.

(3) The carrier, image carrier, charging device and cleaning member are all coincident as to the life, so that devices included in the apparatus can be replaced more efficiently.

(4) When the various devices reach the end of their life, the entire image forming unit can be replaced without increasing the user's economic burden.

Various modifications will become possible for those skilled in the art after receiving the teachings of the present disclosure without departing from the scope thereof.

What is claimed is:

1. An image forming apparatus using a two-ingredient type developer consisting of toner and carrier, comprising:

an image carrier for electrostatically forming a latent image thereon; and a developing device for developing the latent image with the developer to thereby produce a corresponding toner image, wherein said developing device includes a developer carrier for conveying the developer deposited thereon;

wherein said image carrier has a life coincident with a life of the developer.

2. An apparatus as claimed in claim 1, wherein said image carrier has a photoconductive layer on a surface thereof, and wherein the carrier of the developer has a coating layer on a surface thereof.

3. An apparatus as claimed in claim 2, wherein a thickness of said photoconductive layer, a thickness of said coating layer and an amount of the developer are each selected to have a particular value.

4. An apparatus as claimed in claim 1, wherein said image carrier and said developer carrier are constructed into an image forming unit by being assembled together on a unit casing, and wherein a part of said image forming unit forms a developer casing for storing the developer.

5. An apparatus as claimed in claim 1, further comprising:

a charging device for charging said image carrier for forming the latent image; and a cleaning device for removing, after the toner image has been transferred from said image carrier to a recording medium, the toner remaining on said image carrier.

6. An apparatus as claimed in claim 5, wherein a life of said image carrier, a life of the developer, a life of said charging device and a life of said cleaning device are all coincident with each other.

7. An apparatus as claimed in claim 6, wherein said image carrier has a photoconductive layer on a surface thereof, wherein the carrier of the developer has a coating layer on a surface thereof, wherein said charging device comprises a charge roller, and wherein said cleaning device comprises a cleaning blade contacting said photoconductive layer and a cleaning pad pressing said charge roller.

8. An apparatus as claimed in claim 7, wherein a thickness of said photoconductive layer, a thickness of said coating layer, an amount of the developer, a contact pressure of said cleaning blade acting on said photoconductive layer and a contact pressure of said cleaning pad acting on said charge roller are each selected to have a particular value.

9. An apparatus as claimed in claim 5, wherein said image carrier, said developer carrier, said charging device and said cleaning device are constructed into an image forming unit by being assembled together on a unit casing, and wherein a part of said image forming unit forms a developer casing for storing the developer.

10. An apparatus as claimed in claim 9, further comprising a toner recycling device for conveying the toner removed from said image carrier by said cleaning device to said developing device.

11. An apparatus as claimed in claim 10, wherein said toner recycling device comprises a toner conveyance path formed by a part of said unit casing.

12. An image forming unit using a two-ingredient type developer consisting of toner and carrier, comprising:

an image carrier for electrostatically forming a latent image thereon;

a developing device for developing the latent image with the developer to thereby produce a corresponding toner image, wherein said developing device includes a developer carrier for conveying the developer deposited thereon; and a unit casing on which said image carrier and said developer carrier are assembled integrally;

wherein said image carrier has a life coincident with a life of the developer.

13. A unit as claimed in claim 12, further comprising a developer casing for storing the developer.

14. A unit as claimed in claim 12, wherein said image carrier has a photoconductive layer on a surface thereof, and wherein the carrier of the developer has a coating layer on a surface thereof.

15. A unit as claimed in claim 14, wherein a thickness of said photoconductive layer, a thickness of said coating layer and an amount of the developer are each selected to have a particular value.

16. A unit as claimed in claim 12, further comprising:

a charging device for charging said image carrier for forming the latent image; and a cleaning device for removing, after the toner image has been transferred from said image carrier to a recording medium, the toner remaining on said image carrier.

17. A unit as claimed in claim 16, wherein a life of said image carrier, a life of the developer, a life of said charging device and a life of said cleaning device are all coincident with each other.

18. A unit as claimed in claim 17, wherein said image carrier has a photoconductive layer on a surface thereof, wherein the carrier of the developer has a coating layer on a surface thereof, wherein said charging device comprises a charge roller, and wherein said cleaning device comprises a cleaning blade contacting said photoconductive layer and a cleaning pad pressing said charge roller.

19. A unit as claimed in claim 18, wherein a thickness of said photoconductive layer, a thickness of said coating layer, an amount of the developer, a contact pressure of said cleaning blade acting on said photoconductive layer and a contact pressure of said cleaning pad acting on said charge roller are each selected to have a particular value.

20. A unit as claimed in claim 16, wherein said unit casing further comprises said charging device and said cleaning device assembled thereon.

21. A unit as claimed in claim 16, further comprising a toner recycling device for conveying the toner removed from said image carrier by said cleaning device to said developing device.

22. A unit as claimed in claim 21, wherein said toner recycling device comprises a toner conveyance path formed by a part of said unit casing.

23. A method of forming an image with a two-ingredient type developer consisting of toner and carrier, comprising the steps of:

(a) electrostatically forming a latent image on an image carrier;

(b) developing the latent image with the developer conveyed by a developer carrier of a developing device to thereby form a corresponding toner image; and (c) causing a life of said image carrier and a life of the developer to coincide with each other.

24. A method as claimed in claim 23, wherein said image carrier has a photoconductive layer on a surface thereof, and wherein the carrier of the developer has a coating layer on a surface thereof.

25. A method as claimed in claim 24, wherein step (c) comprises selecting a particular thickness of said photoconductive layer, a particular thickness of said coating layer, and a particular amount of the developer.

26. A method of forming an image with a two-ingredient type developer consisting of toner and carrier, comprising the steps of:

(a) charging an image carrier by a charging device;

(b) electrostatically forming a latent image on said image carrier charged by said charging device;

(c) developing the latent image with the developer conveyed by a developer carrier of a developing device to thereby produce a corresponding toner image;

(d) removing, after the toner image has been transferred from said image carrier to a recording medium, the toner remaining on said image carrier by a cleaning device; and (e) causing a life of said image carrier, a life of the developer, a life of said charging device and a life of said cleaning device to coincide with each other.

27. A method as claimed in claim 26, wherein said image carrier has a photoconductive layer on a surface thereof, wherein the carrier of the developer has a coating layer on a surface thereof, wherein said charging device comprises a charge roller, and wherein said cleaning device comprises a cleaning blade contacting said photoconductive layer and a cleaning pad pressing said charge roller.

28. An apparatus as claimed in claim 27, wherein step (e) comprises selecting a particular thickness of said photoconductive layer, a particular thickness of said coating layer, a particular amount of the developer, a particular contact pressure of said the photoconductive layer said photoconductive layer, and a particular contact pressure of said cleaning pad acting on said charge roller.

* * * * *